US010297206B2

(12) United States Patent
Yata et al.

(10) Patent No.: US 10,297,206 B2
(45) Date of Patent: May 21, 2019

(54) DISPLAY DEVICE

(71) Applicant: Japan Display Inc., Tokyo (JP)

(72) Inventors: Tatsuya Yata, Tokyo (JP); Takayuki Nakanishi, Tokyo (JP); Masaya Tamaki, Tokyo (JP)

(73) Assignee: Japan Display Inc., Tokyo (JP)

( * ) Notice: Subject to any disclaimer, the term of this patent is extended or adjusted under 35 U.S.C. 154(b) by 558 days.

(21) Appl. No.: 15/040,149

(22) Filed: Feb. 10, 2016

(65) Prior Publication Data

US 2016/0260388 A1 Sep. 8, 2016

(30) Foreign Application Priority Data

Mar. 2, 2015 (JP) ..... 2015-040323

(51) Int. Cl.

*G09G 5/00* (2006.01)
*G09G 3/34* (2006.01)
*G09G 3/36* (2006.01)

(52) U.S. Cl.

CPC ..... *G09G 3/3406* (2013.01); *G09G 3/3413* (2013.01); *G09G 3/3607* (2013.01); *G09G 5/00* (2013.01); *G09G 2300/0456* (2013.01); *G09G 2320/0271* (2013.01); *G09G 2320/0626* (2013.01); *G09G 2320/0633* (2013.01); *G09G 2360/144* (2013.01)

(58) Field of Classification Search

CPC ..... G09G 5/00
See application file for complete search history.

(56) References Cited

U.S. PATENT DOCUMENTS

2002/0000970 A1* 1/2002 Akimoto ..... G09G 3/3648 345/100
2008/0037976 A1* 2/2008 Funaki ..... G03B 13/18 396/108
2011/0096084 A1* 4/2011 Hu ..... G09G 3/3413 345/589
2012/0162532 A1* 6/2012 Oniki ..... G09G 3/3406 348/725
2012/0268437 A1* 10/2012 Lee ..... G09G 3/20 345/207
2012/0299891 A1* 11/2012 Fujiwara ..... G09G 3/3426 345/207

FOREIGN PATENT DOCUMENTS

JP 2013-218057 10/2013

* cited by examiner

*Primary Examiner* — Temesghen Ghebretinsae
*Assistant Examiner* — Paras D Karki
(74) *Attorney, Agent, or Firm* — K&L Gates LLP

(57) ABSTRACT

According to an aspect, a display device includes: a display unit; a lighting unit emitting internal light; a measurement unit; and a control unit controlling an intensity of the internal light and a gradation value of each pixel in the display unit. The control unit calculates a required luminance value for a luminance value of a pixel to be N times as high as a luminance value indicated by an input signal, the pixel performing output with the largest gradation value out of the pixels in a predetermined image display region. The control unit determines the intensity of the internal light based on an intensity of the external light measured by the measurement unit and the required luminance value, and calculates an output gradation value based on the gradation value indicated by input signal, the intensity of the external light, and the intensity of the internal light.

9 Claims, 15 Drawing Sheets

FIG.16

| | DEFINITION OF WHITE IN INPUT SIGNAL | WHITE POINT | CORRECTED GRADATION VALUE OF WHITE |
|---|---|---|---|
| COLOR COMPONENT (HIGH) ↕ (LOW) | R G B | R G B | R G B |
| RGB GRADATION VALUE | 255, 255, 255 | 255, 204, 204 | 255, 204, 204 |
| RATIO OF R:G:B | 1:1:1 | 1:0.8:0.8 | 1:0.8:0.8 |

FIG.17

| | INPUT SIGNAL | WHITE POINT | MAGNIFICATION OF LUMINANCE (N) | REQUIRED LUMINANCE VALUE |
|---|---|---|---|---|
| COLOR COMPONENT (HIGH) ↕ (LOW) | R G B | R G B (1:0.8:0.8) | ×2 | R G B |
| FORMULA<br>R<br>G<br>B | <br>180<br>225<br>80 | <br>×1<br>×0.8<br>×0.8 | <br>×2<br>×2<br>×2 | <br>=360<br>=360<br>=128 |

FIG.18

| | REQUIRED LUMINANCE VALUE | LARGEST VALUE OF REFLECTION LUMINANCE GENERATED BY EXTERNAL LIGHT | TO-BE-ADDED LUMINANCE (Rf, Gf, Bf) |
|---|---|---|---|
| COLOR COMPONENT (HIGH) ↑ ↓ (LOW) | 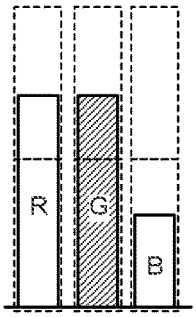  | 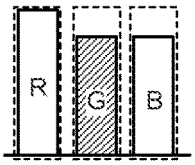  | 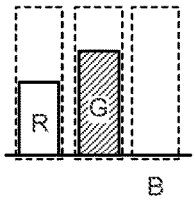  |
| FORMULA<br>R<br>G<br>B | <br>360<br>360<br>128 | <br>-255<br>-204<br>-204 | <br>=105 (Rf)<br>=156 (Gf)<br>=0 (Bf) |

FIG.19

| UNIT OF PROCESS-ING | REQUIRED LUMINANCE VALUE OF UNIT PIXEL | | | TO-BE-ADDED LUMINANCE | | | FLMAX | INTENSITY OF INTERNAL LIGHT |
|---|---|---|---|---|---|---|---|---|
| | Rt | Gt | Bt | Rf | Gf | Bf | | |
| $U_1$ | 360 | 360 | 128 | 105 | 156 | 0 | 0.61 | 0.61 |
| | 300 | 300 | 100 | | | | | |
| | 200 | 200 | 50 | | | | | |
| | 100 | 100 | 25 | | | | | |
| | 50 | 50 | 0 | | | | | |
| | ⋮ | ⋮ | ⋮ | | | | | |
| $U_2$ | 360 | 250 | 100 | 105 | | | 0.41 | 0.61 |
| | 300 | 360 | 100 | | 156 | | 0.61 | |
| | 100 | 100 | 128 | | | 0 | 0 | |
| | 100 | 100 | 25 | | | | | |
| | 50 | 50 | 0 | | | | | |
| | ⋮ | ⋮ | ⋮ | | | | | |

FIG.20
| | REQUIRED LUMINANCE VALUE | INTERNAL LIGHT +EXTERNAL LIGHT | OUTPUT SIGNAL (O (R, G, B)) |
|---|---|---|---|
| COLOR COMPONENT (HIGH) (LOW) | 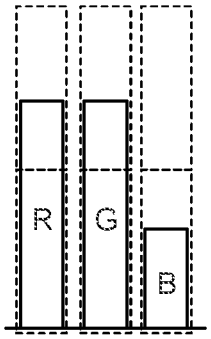  | 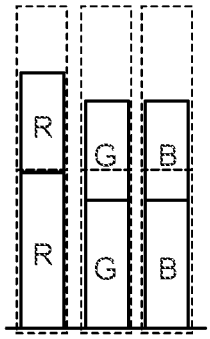  | 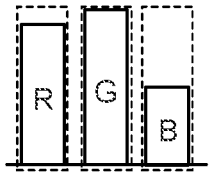  |
| FORMULA<br>R<br>G<br>B | 360<br>360<br>128 | /{(255+156)/255}<br>/{(204+156)/255}<br>/{(204+156)/255} | =223 (O (R))<br>=255 (O (G))<br>=91 (O (B)) |
FIG.21
| UNIT OF PROCESSING | LARGEST REQUIRED LUMINANCE VALUE OF EACH COLOR | | | INTENSITY OF INTERNAL LIGHT |
|---|---|---|---|---|
| | Rt | Gt | Bt | |
| $U_1$ | 360 | 360 | 128 | 0.61 |
| $U_2$ | 360 | 360 | 128 | 0.61 |
| $U_3$ | 360 | 128 | 128 | 0.41 |
| $U_4$ | 200 | 200 | 128 | 0 |
| ⋮ | ⋮ | ⋮ | ⋮ | ⋮ |

| UNIT OF PROCESSING | REQUIRED LUMINANCE VALUE OF UNIT PIXEL | | | INTENSITY OF INTERNAL LIGHT | OUTPUT SIGNAL | | |
|---|---|---|---|---|---|---|---|
| | Rt | Gt | Bt | | O (R) | O (G) | O (B) |
| $U_1$ | 360 | 360 | 128 | 0.61 | 223 | 255 | 91 |
| | 300 | 300 | 100 | | 186 | 213 | 71 |
| | 200 | 200 | 50 | | 124 | 141 | 35 |
| | 100 | 100 | 25 | | 62 | 71 | 18 |
| | 50 | 50 | 0 | | 31 | 35 | 0 |
| | ⋮ | ⋮ | ⋮ | | ⋮ | ⋮ | ⋮ |

DISPLAY DEVICE

CROSS-REFERENCE TO RELATED APPLICATIONS

This application claims priority from Japanese Application No. 2015-040323, filed on Mar. 2, 2015, the contents of which are incorporated by reference herein in its entirety.

BACKGROUND

1. Technical Field

The present invention relates to a display device.

2. Description of the Related Art

There have been conventionally developed display devices including a lighting device (front light) that irradiates a display panel including reflective display elements with light emitted from a dedicated light source.

Reflective display devices also reflect light, such as light around them, other than the light emitted from the dedicated light source. In other words, the brightness of the reflective display devices in display output is affected by the light other than the light emitted from the dedicated light source. When the intensity of light (e.g., external light) other than the light emitted from the dedicated light source is low or when a user determines that extra light is required, the conventional reflective display devices use the light from the dedicated light source to perform display. The conventional reflective display devices, however, may possibly perform the display output with too much brightness depending on the intensity of light other than the light emitted from the dedicated light source. Furthermore, because the conventional reflective display devices keep the output of light from the dedicated light source constant based on the intensity of external light, the amount of electric power is determined based on the external light intensity.

For the foregoing reasons, there is a need for a display device that can perform display output with brightness based on the intensity of light (e.g., external light) other than light from a dedicated light source and can suppress output from the light source depending on image data when the dedicated light source is required.

SUMMARY

According to an aspect, a display device that is a reflective display device includes: a display unit including a plurality of pixels; a lighting unit emitting light to the display unit; a measurement unit measuring an intensity of external light serving as light other than internal light out of light with which the display unit is irradiated, the internal light emitting from the lighting unit; and a control unit controlling an intensity of the internal light and a gradation value of each of the pixels based on the intensity of the external light measured by the measurement unit. The control unit calculates a required luminance value for a luminance value of a pixel to be N times (N>0) as high as a luminance value indicated by an input signal, the pixel performing output with the largest gradation value out of the pixels included in a predetermined image display region in the display unit. The control unit determines the intensity of the internal light based on a result of comparison between the intensity of the external light and the required luminance value. The control unit calculates an output gradation value of each of the pixels based on Equation (1):

$$O=I\times N/(OL+\mathrm{IL}) \quad (1)$$

where OL denotes the intensity of the external light, IL denotes the intensity of the internal light, I denotes the gradation value indicated by the input signal, and O denotes the output gradation value of the pixel.

BRIEF DESCRIPTION OF THE DRAWINGS

FIG. 16 is a diagram of an example of setting of a white point;

FIG. 17 is a diagram of an example where an input signal is corrected using the white point and the magnification of luminance;

FIG. 18 is a diagram of an example of calculation of to-be-added luminance;

FIG. 19 is a diagram of an example of processing for deriving the intensity of internal light for each unit of processing;

FIG. 20 is a diagram of an example of an arithmetic operation for determining an output signal;

FIG. 21 is a diagram of an example of control on the internal light and calculation of the gradation values for each unit of processing;

DETAILED DESCRIPTION

Figure 1:
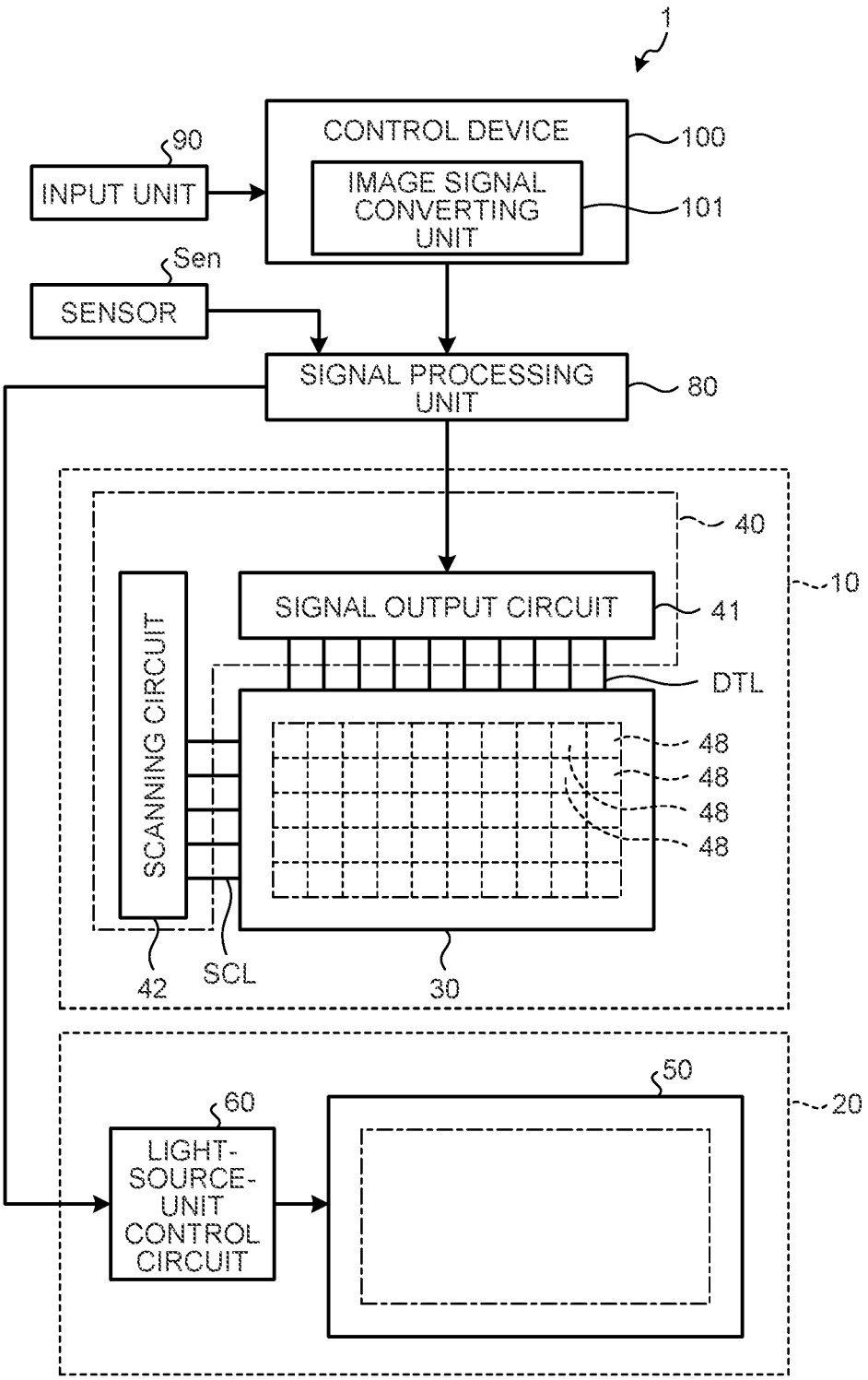
FIG. 1 is a block diagram of an exemplary main configuration of an electronic apparatus including a display device according to an embodiment.

Exemplary embodiments according to the present disclosure are described below with reference to the accompanying drawings. The disclosure is given by way of example only, and various changes and modifications made without departing from the spirit of the present invention and easily conceivable by those skilled in the art are naturally included in the scope of the invention. To simplify the description, the drawings may possibly illustrate the width, the thickness, the shape, and other elements of each unit more schematically than an actual aspect. These elements, however, are given by way of example only and are not intended to limit interpretation of the invention. In the specification and the figures, components similar to those previously described with reference to a preceding figure are denoted by the same reference numerals, and detailed description thereof will be appropriately omitted.

Figure 2:
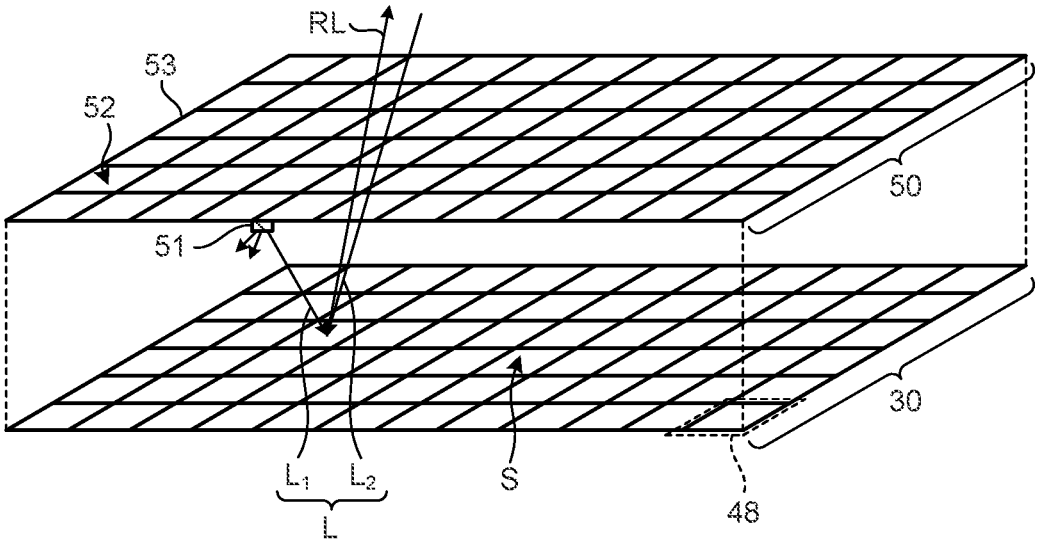
FIG. 2 is a schematic exploded perspective view of the display device including a lighting device according to the embodiment.

FIG. 1 is a block diagram of an exemplary main configuration of an electronic apparatus 1 including a display device according to an embodiment. FIG. 2 is a schematic exploded perspective view of the display device. As illustrated in FIG. 1, the display device includes a reflective display unit 10, a lighting unit 20, a sensor Sen, and a signal processing unit 80. The display unit 10 includes a plurality of pixels 48. The lighting unit 20 irradiates the display unit 10 with light. The sensor Sen measures external light intensity. The signal processing unit 80 serves as a control unit of the display device. The electronic apparatus 1 including the display device further includes an input unit 90 for inputting various types of data to the electronic apparatus 1, and a control device 100 performing various types of processing for an operation of the electronic apparatus 1, for example.

The display unit 10 includes a display panel 30 and a display panel drive circuit 40, for example. The display panel 30 is a reflective display panel and displays video using at least one of light (internal light $L_1$) that is emitted from the lighting unit 20 and light (external light $L_2$) other than the light from the lighting unit 20. The display panel 30 includes the pixels 48 arranged in a two-dimensional matrix and reflective display elements provided in the respective pixels 48. Examples of the reflective display element include, but are not limited to, an electrophoretic element, a liquid-crystal element such as liquid crystal on silicon (LCOS), a micro electro mechanical systems (MEMS) element, an electrowetting element, an electrochromic element.

Figure 3:
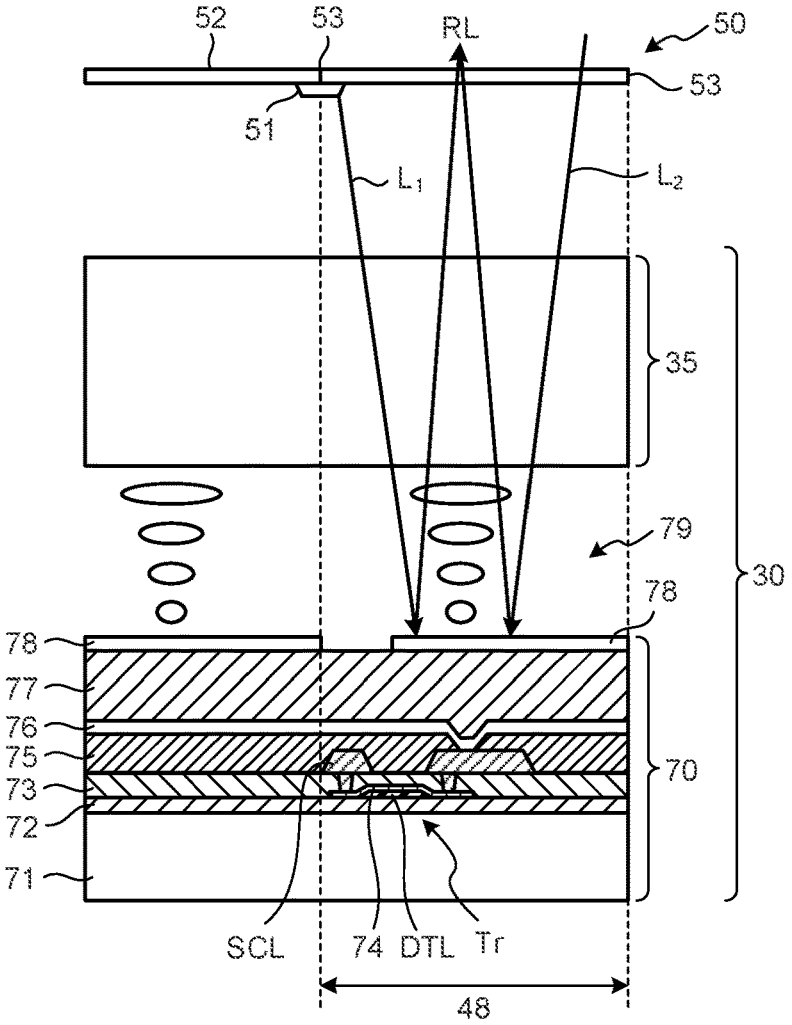
FIG. 3 is a diagram of an example of a cross sectional structure of a display panel and a light source unit.

FIG. 3 is a diagram of an example of the cross sectional structure of the display panel 30 and a light source unit 50. FIG. 3 illustrates an example of the cross sectional structure in a case where the reflective display element is a liquid-crystal element including a liquid-crystal layer 79. As illustrated in FIG. 3, the display panel 30 includes a first substrate (pixel substrate) 70, a second substrate (counter substrate) 35, and the liquid-crystal layer 79. The second substrate 35 is arranged facing in a direction perpendicular to the surface of the first substrate 70. The liquid-crystal layer 79 is provided between the first substrate 70 and the second substrate 35.

The first substrate 70 is provided with various circuits on a translucent substrate 71. The first substrate 70 includes a plurality of first electrodes (pixel electrodes) 78 arranged in a matrix, and a second electrode (common electrode) 76 above the translucent substrate 71. The first electrodes 78 and the second electrodes 76 are insulated from each other by an insulation layer 77 and face each other in a direction perpendicular to the surface of the translucent substrate 71. The first electrodes 78 and the second electrodes 76 are translucent electrodes made of a translucent conductive material (translucent conductive oxide), such as indium tin oxide (ITO).

The first substrate 70 includes a semiconductor layer 74 and wiring, such as signal lines DTL and scanning lines SCL, above the translucent substrate 71. The semiconductor layer 74 is provided with transistors Tr serving as switching elements of the respective pixels 48. The signal lines DTL supply pixel signals to the first electrodes 78, and the scanning lines SCL drive the transistors Tr. The semiconductor layer 74, the signal lines DTL, and the scanning lines SCL are laminated in a manner insulated from one another by insulation layers 72, 73, and 75.

The first electrode 78 serves as a reflection unit that reflects entering light L (refer to FIG. 2) containing the internal light $L_1$ and the external light $L_2$ and generates reflected light RL. The intensity of the reflected light RL with respect to the intensity of the entering light L varies depending on the degree of modulation performed by the liquid-crystal layer 79. Specifically, by controlling the orientation of liquid crystals in the liquid-crystal layer 79, the transmittance of light passing through the liquid-crystal layer 79 is changed to control the luminance of the pixels 48.

The configuration of the display panel 30 is not limited. The display panel 30 may be a known device, such as a reflective liquid-crystal display panel and electronic paper (e.g., electrophoretic paper). The display panel 30 may perform monochromatic display or color display using color filters of a plurality of colors, for example. The display panel 30, for example, includes a front panel provided with the transparent common electrodes, a rear panel provided with the pixel electrodes, and a liquid-crystal material provided between the front panel and the rear panel. In the display panel 30, the pixel electrodes may be made of a material that reflects light, or a reflection film made of metal or the like may reflect light in a combination of the reflection film and translucent pixel electrodes. The embodiment employs the electrically controlled birefringence (ECB) mode, which is one of the longitudinal electric-field modes, as the drive mode of liquid crystals. The embodiment may employ another longitudinal electric-field mode, such as the twisted nematic (TN) mode and the vertical alignment (VA) mode. Alternatively, the liquid crystals may be driven by a lateral electric-field mode, such as the in-plane switching (IPS) mode and the fringe field switching (FFS) mode. The display panel 30 may be a liquid-crystal display panel including both a reflective display region and a transmissive display region in the pixel 48, for example.

Figure 4:
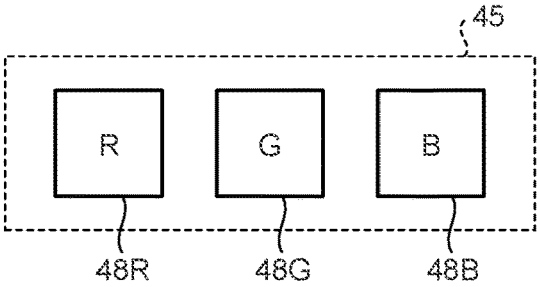
FIG. 4 is a diagram of an example of a unit of color reproduction performed by a plurality of pixels serving as sub-pixels.

FIG. 4 is a diagram of an example of a unit of color reproduction performed by the pixels 48 serving as sub-pixels. The pixels 48 according to the embodiment each serve as a sub-pixel that outputs any one of a plurality of colors. The display unit 10 combines output from the sub-pixels, thereby performing color reproduction.

Specifically, the pixels 48 each serve as a sub-pixel that outputs any one of the colors of red (R), green (G), and blue (B). The display unit 10 combines output from a sub-pixel 48R for R, a sub-pixel 48G for G, and a sub-pixel 48B for B, thereby performing color reproduction based on RGB signals. The combination of the sub-pixels for performing color reproduction based on RGB signals may be hereinafter referred to as a unit pixel 45. While one unit pixel 45 according to the embodiment includes one sub-pixel 48R for R, one sub-pixel 48G for G, and one sub-pixel 48B for B, this is given by way of example only. The configuration of the unit pixel 45 is not limited thereto and may be appropriately changed. While the pixels 48 have a square shape in FIGS. 1 to 4, this is given by way of schematic illustration only and does not necessarily illustrate the shape of the actual pixels 48. The pixels 48 may have a polygonal shape, such as a rectangle and a tetragon. To describe a matter for which the colors of the sub-pixels need not particularly be distinguished, the sub-pixels may be referred to as the pixels 48. The pixel 48 illustrated in FIGS. 1 and 2 is any one of the sub-pixel 48R for R, the sub-pixel 48G for G, and the sub-pixel 48B for B, for example.

The display unit 10 includes the pixels 48 arranged in a matrix along two directions (e.g., an X-direction and a Y-direction orthogonal to each other) intersecting with each other along a plane, for example. While the sub-pixels constituting one unit pixel 45 according to the embodiment are arranged side by side along the X-direction, this is given by way of example only. The arrangement of the sub-pixels is not limited thereto and may be appropriately changed. In the display panel 30 according to the embodiment, a plurality of unit pixels 45 are arranged in a matrix.

The shape of the display panel 30 is not limited and may be a horizontally long rectangle or a vertically long rectangle, for example. Let us assume a case where a number of unit pixels 45 (pixels) of MλN in the display unit 10 is represented by (M,N), and the number of sub-pixels is represented by Q. If the display panel 30 has a horizontally long rectangular shape, for example, several types of resolution for image display can be employed as the values of (M,N), such as (640×Q,480), (800×Q,600), and (1024×Q, 768). If the display panel 30 has a vertically long rectangular shape, resolution obtained by switching the values described above can be employed.

At least a part of the display panel 30 may be flexible. In this case, the display unit 10 includes a plastic substrate, reflective display elements such as electrophoretic elements, and drive elements such as organic thin film transistors (TFTs), for example.

The display panel drive circuit 40 includes a signal output circuit 41 and a scanning circuit 42. The display panel drive circuit 40 retains video signals in the signal output circuit 41 and sequentially outputs them to the display panel 30. The signal output circuit 41 is electrically coupled to the display panel 30 with the wiring DTL. The scanning circuit 42 is electrically coupled to the display panel 30 with the wiring SCL. The signal output circuit 41 appropriately outputs, in synchronization with the scanning circuit 42, output signals output from the signal processing unit 80. The scanning circuit 42 controls on/off of switching elements (e.g., TFTs) for controlling an operation (light transmittance) based on the gradation values of the sub-pixels in the display panel 30. The scanning circuit 42 turns on the switching elements in the pixels 48 coupled to the wiring SCL based on the positions of the pixels 48 indicated by the output signal output from the signal processing unit 80.

The lighting unit 20 includes the light source unit 50 and a light-source-unit control circuit 60, for example. The light source unit 50 is arranged facing a display surface S of the display panel 30 to irradiate the surface and transmit light reflected by the display surface therethrough. In other words, the light source unit 50 is what is called a front light that irradiates the display surface S of the display panel 30 with the internal light $L_1$. The light source unit 50 includes a light-emitting unit 51 provided on a translucent substrate and including a light-emitting element, for example. The translucent substrate, for example, may be made of glass or various plastic materials (e.g., PMMA, polycarbonate resin, acrylic resin, amorphous polypropylene resin, or styrene resin including AS resin). The light-emitting unit 51, for example, includes an organic electric-field light-emitting element (organic electroluminescence (EL) element), an inorganic electric-field light-emitting element (inorganic EL element), an organic light-emitting diode (OLED), or a micro light-emitting diode (micro-LED). The light-emitting unit 51 emits the internal light $L_1$ toward the display surface S of the display panel 30.

The light source unit 50 has an aperture 52 and a light-shielding portion 53. The aperture 52 is formed correspondingly to the region of each pixel 48 (pixel region) in the display panel 30. The light-shielding portion 53 is formed in a grid shape and provided to the region between the pixels 48 (region between pixels) in the display panel 30. The light-shielding portion 53 serves as a black matrix (BM) and is made of a predetermined black resin material, for example. As illustrated in FIG. 2, the internal light $L_1$, which is a part or all of the entering light L, enters the liquid-crystal layer 79. The internal light $L_1$ is then reflected by the first electrode 78 and emitted as the reflected light RL. Specifically, as illustrated in FIG. 3, the external light $L_2$ passing through the aperture 52 and the internal light $L_1$ are emitted as the reflected light RL. The intensity of the reflected light RL varies depending on the light transmittance of the liquid-crystal layer 79 determined under the control of the signal processing unit 80.

Figure 5:
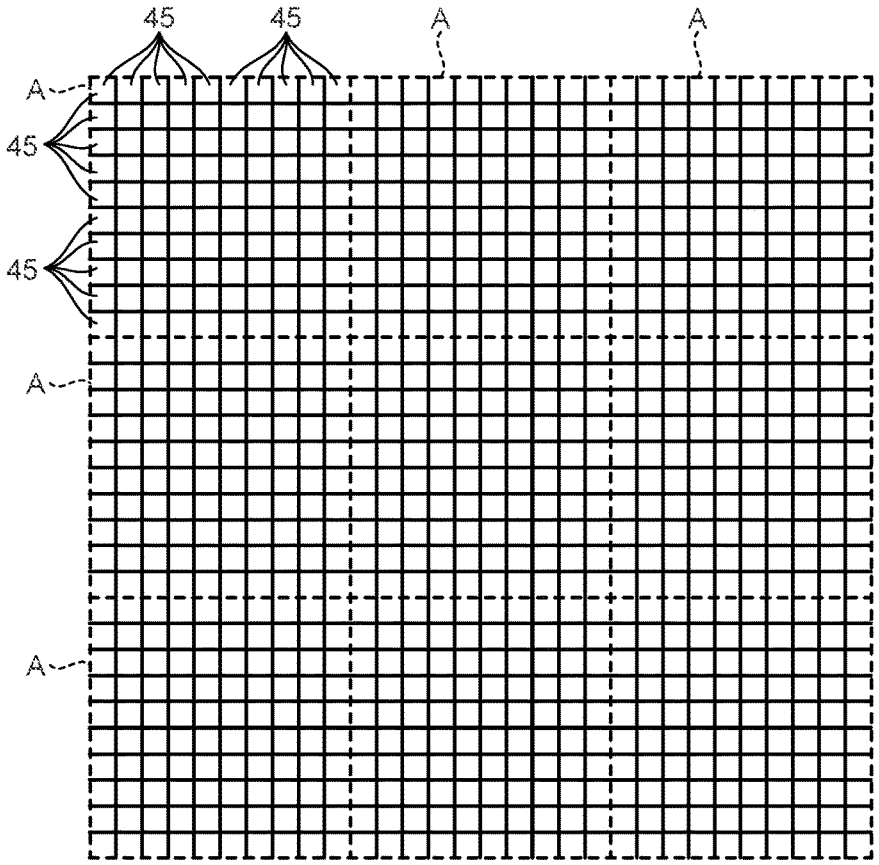
FIG. 5 is a diagram of an example of the relation between partial regions and unit pixels.

FIG. 5 is a diagram of an example of the relation between partial regions and the unit pixels 45. The display unit 10 according to the embodiment includes a plurality of partial regions each having a plurality of pixels 48. The lighting unit 20 includes a plurality of light-emitting regions that individually irradiate the respective partial regions with light. The light-emitting regions can individually control the intensity of the internal light $L_1$. Specifically, the display panel 30 according to the embodiment includes a plurality of partial regions each serving as a unit of control on the output signals under the control of the signal processing unit 80. The partial regions each include a plurality of (e.g., X×Y=10×10) unit pixels 45. In FIG. 5, one rectangle indicated by the solid lines corresponds to one unit pixel 45, and one rectangle represented by A and indicated by the broken lines corresponds to one partial region. The light-emitting regions in the light source unit 50 each include at least one light-emitting unit 51. The lighting unit 20 can individually irradiate the partial regions in the display panel 30 with light emitted from the respective light-emitting regions. In the following description, a combination of one partial region among the partial regions and one light-emitting region that irradiates the one partial region with light may be referred to as one unit of processing.

The light-source-unit control circuit 60 controls the quantity of light to be emitted from the light source unit 50, for example. Specifically, the light-source-unit control circuit 60 adjusts a voltage or a duty ratio supplied to the light-emitting units 51 provided to the respective light-emitting regions in the light source unit 50 based on light-emitting region control signals output from the signal processing unit 80. Thus, the light-source-unit control circuit 60 controls the intensity of light (internal light $L_1$) with which the partial regions are irradiated.

The sensor Sen measures the intensity of light (external light $L_2$) not emitted from the lighting unit 20 out of the light with which the display unit 10 is irradiated. Specifically, the sensor Sen includes a component (e.g., a photodiode) that performs output corresponding to the intensity of detected light and a circuit that converts the output into a numerical value and data and outputs it, for example. The sensor Sen may further include a component that disperses light, such as a filter. The sensor Sen may disperse the external light $L_2$ into light with colors corresponding to a part or all of the colors of the pixels 48 in the display unit 10 to measure the intensities of the light of the respective colors. The sensor Sen according to the embodiment measures the light intensities of spectra of R, G, and B individually.

The signal processing unit 80 may be an integrated circuit, such as a field-programmable gate array (FPGA). The integrated circuit serves as an arithmetic unit and a storage unit, for example. The arithmetic unit is provided by the integrated circuit and other components. The storage unit stores therein various data relating to an arithmetic operation performed by the arithmetic unit. The signal processing unit 80 calculates an output signal to be supplied to the display unit 10 for each pixel and an output signal to be supplied to the lighting unit 20 for adjusting the brightness of each light-emitting unit 51, for example. The signal processing unit 80 calculates these output signals based on the brightness of the screen set by the input unit 90 and the external light intensity measured by the sensor Sen, for example.

The input unit 90, for example, includes a touch panel sensor integrated with the display unit 10, and/or a switch provided to the electronic apparatus 1. A user can perform various types of input relating to the operation of the electronic apparatus 1 by performing an operation on the input unit 90. Specifically, the user can make settings for the brightness of the screen in image display performed by the display unit 10, for example, by performing an operation on the input unit 90.

The control device 100, for example, may be an integrated circuit, such as a FPGA. The integrated circuit serves as an arithmetic unit and a storage unit, for example. The arithmetic unit performs various types of arithmetic processing relating to display output. The storage unit stores therein various data relating to an arithmetic operation performed by the arithmetic unit. The control device 100 serves as an image signal converting unit 101 that converts a plurality of pixel values (gradation values) constituting data of an image to be displayed by the display device into input signals to be input to the display device, for example. The input signals are RGB signals, for example, and contain information on the gradation values of the sub-pixels 48R for R, the sub-pixel 48G for G, and the sub-pixel 48B for B in each unit pixel 45. The image signal converting unit 101 outputs the input signals to the signal processing unit 80.

Figure 6:
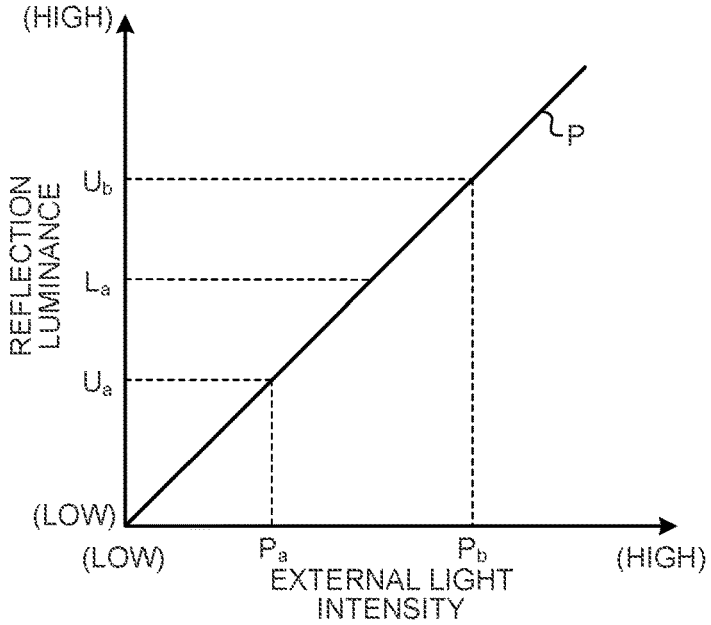
FIG. 6 is a graph schematically illustrating the relation between an external light intensity and reflection luminance when the unit pixel outputs the largest gradation value.
Figure 7:
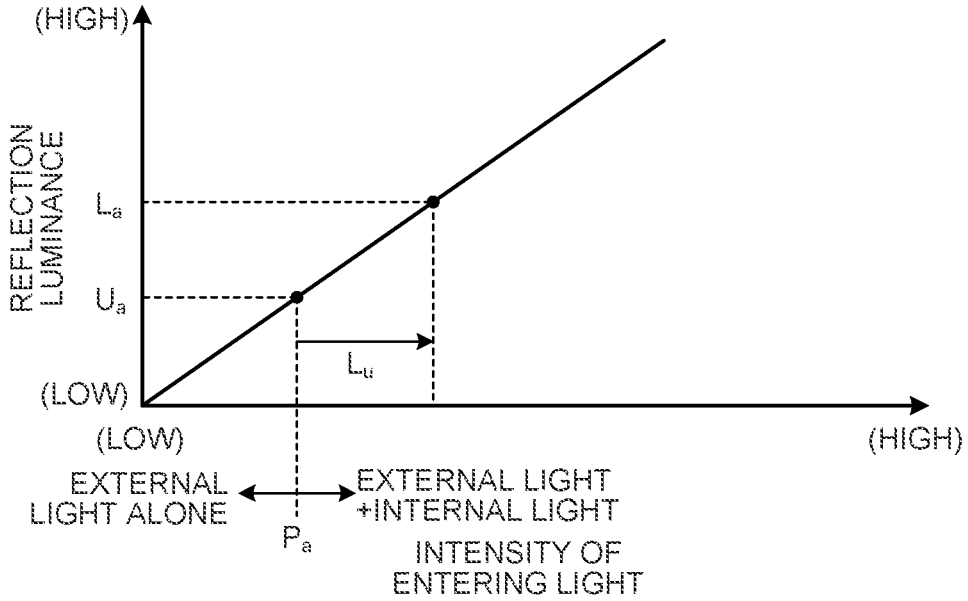
FIG. 7 is a graph illustrating an example of adjustment of internal light performed when an external light intensity high enough to provide predetermined reflection luminance is not obtained.
Figure 8:
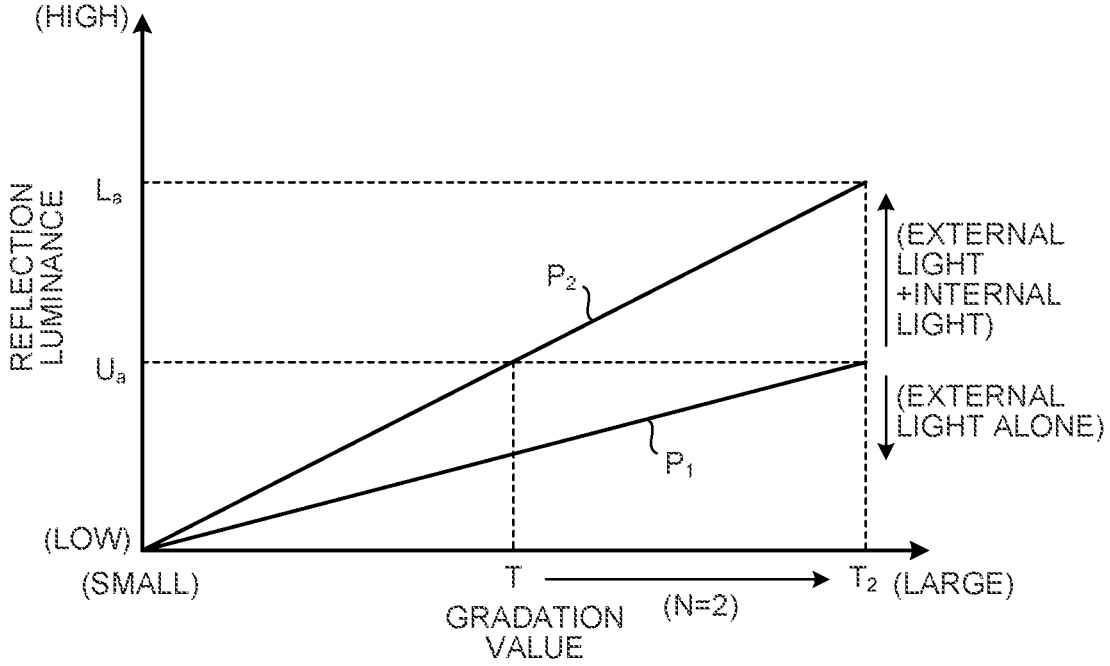
FIG. 8 is a graph illustrating another example of adjustment of internal light performed when an external light intensity high enough to provide the predetermined reflection luminance is not obtained.
Figure 9:
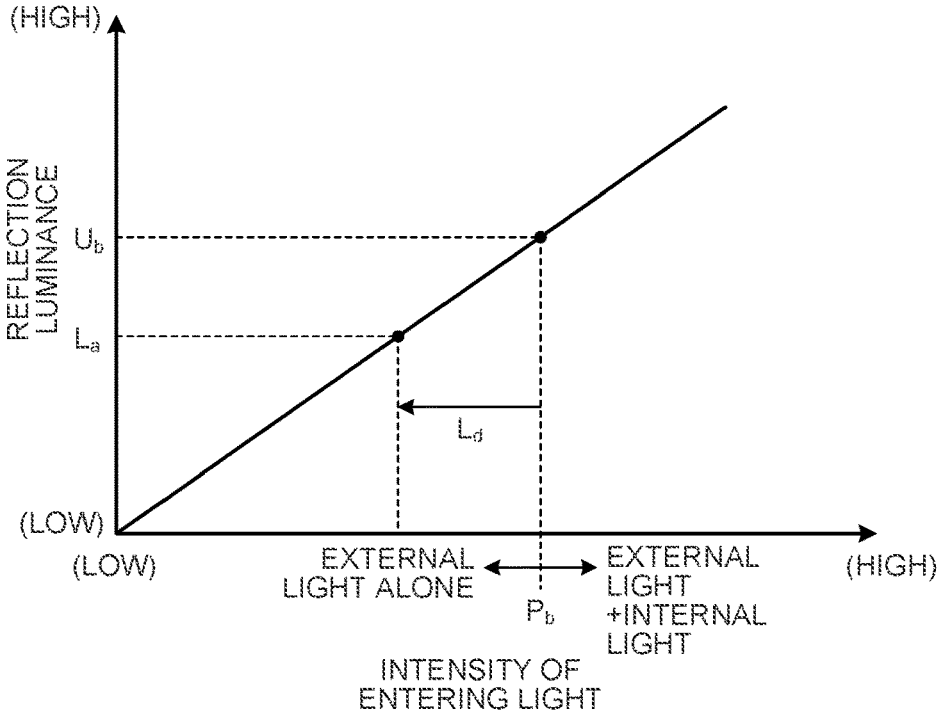
FIG. 9 is a graph illustrating an example of correction of the gradation value of a pixel performed when the external light intensity is too high with respect to the predetermined reflection luminance.
Figure 10:
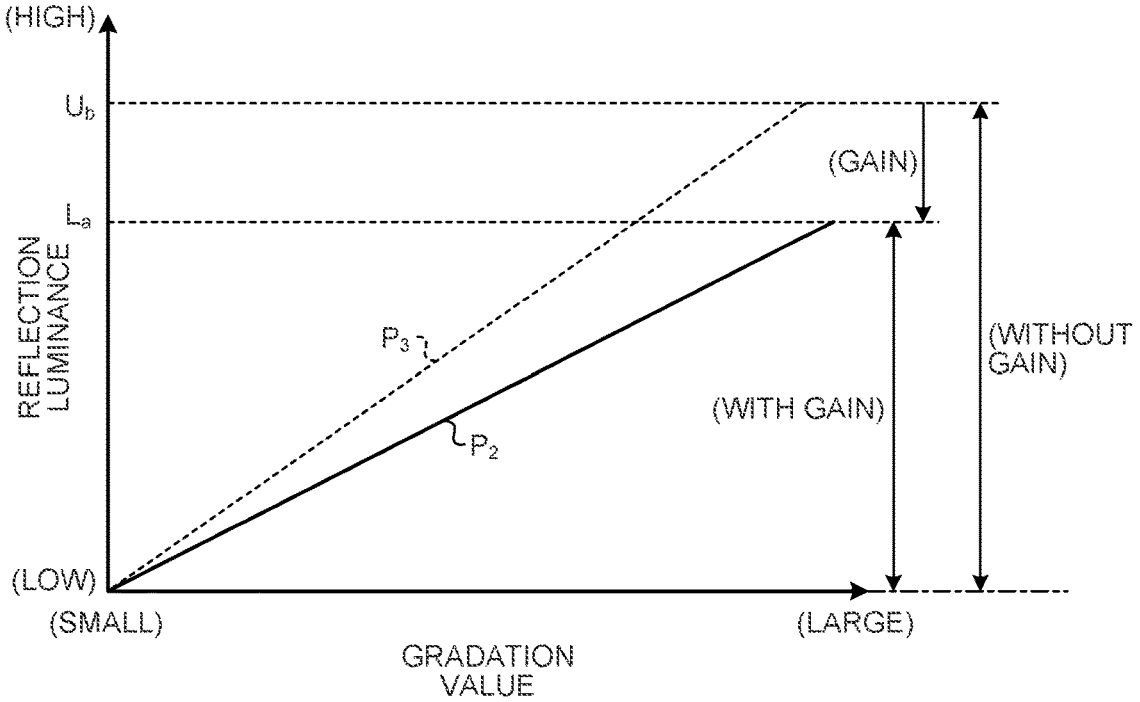
FIG. 10 is a graph illustrating another example of correction of the gradation value of a pixel performed when the external light intensity is too high with respect to the predetermined reflection luminance.

The display device according to the embodiment will be described in greater detail. The following briefly describes the relation between predetermined reflection luminance, the external light $L_2$, and the internal light $L_1$. FIG. 6 is a graph schematically illustrating the relation between the external light intensity and the reflection luminance when the unit pixel 45 outputs the largest gradation value. In the embodiment, when the unit pixel 45 outputs the largest gradation value, that is, when the unit pixel 45 performs output correspondingly to an input signal (R,G,B)=(255,255,255), the unit pixel 45 is in a "white display state" to output white having the highest luminance. "White display" means display resulting from output (R,G,B)=(255,255,255) without performing correction thereon and is not affected by the ratio of colors defined by a white point, which will be described later. In FIG. 6, the line P indicates the relation between the external light intensity and the reflection luminance of the pixel 48 in the white display state. $U_a$ and $U_b$ in FIG. 6 indicate reflection luminance at external light intensities $P_a$ and $P_b$, respectively, of specific two patterns. The external light intensities $P_a$ and $P_b$ satisfy $P_a<P_b$, and the reflection luminance $U_a$ and $U_b$ satisfies $U_a<L_a<U_b$. FIGS. 7 and 8 are graphs illustrating an example of control performed when an external light intensity high enough to provide predetermined reflection luminance is not obtained. FIGS. 9 and 10 are graphs illustrating an example of control performed when the external light intensity is too high with respect to the predetermined reflection luminance. The predetermined reflection luminance, for example, may be reflection luminance corresponding to the brightness of the screen set by the user who uses the electronic apparatus 1, or may be reflection luminance at which the user who uses the electronic apparatus 1 statistically feels the screen to be easy to view. In the following description with reference to FIGS. 7 to 10, let us assume a case where it is desired to obtain reflection luminance $L_a$ in the white display state.

As illustrated in FIG. 7, for example, the display unit 10 may possibly fail to secure the predetermined reflection luminance $L_a$ at the reflection luminance $U_a$ provided only by the external light $L_2$. In this case, the signal processing unit 80 performs signal processing for irradiating the display region with light having the intensity corresponding to a luminance deficiency $L_u$ with the light-emitting unit 51. The signal processing makes it possible to irradiate the reflective electrodes with light having the intensity required for the reflection luminance.

In the example illustrated in FIG. 8, the reflection luminance $U_a$ is obtained in the white display state according to gradation characteristics $P_1$ of the unit pixel 45 obtained only by the external light $L_2$. In other words, to provide reflection luminance (e.g., reflection luminance $L_a$) higher than the reflection luminance $U_a$, it is necessary to increase the intensity of the entering light L by irradiating the display panel 30 with the internal light $L_1$ besides the external light $L_2$. To output a gradation value requiring reflection luminance higher than the reflection luminance $U_a$ under the condition that the display unit 10 is irradiated with the external light $L_2$ alone as illustrated in FIG. 8, the light-emitting unit 51 is turned on. Specifically, the light-emitting unit 51 is turned on so as to emit light having the intensity corresponding to the deficiency luminance $L_u$ illustrated in FIG. 7. Thus, the gradation characteristics of the unit pixel 45 are turned into gradation characteristics $P_2$ that has larger reflection luminance corresponding to the gradation value than that of the gradation characteristics $P_1$ and that can obtain the reflection luminance $L_a$ in the white display state.

In the example illustrated in FIG. 8, T denotes a gradation value for outputting light at the reflection luminance $U_a$ under the gradation characteristic $P_2$. To output light at the reflection luminance $U_a$, however, the light-emitting unit 51 need not be turned on. By setting the gradation value to the value in the white display state, it is possible to obtain the reflection luminance $U_a$ with the entering light L composed of the external light $L_2$ alone. Naturally, the reflection luminance $U_a$ may be provided by performing output of the gradation value T in a state where the unit pixel 45 has the gradation characteristics $P_2$ using the light-emitting unit 51. To output light at the reflection luminance $U_a$, one of the following operations are performed: control on the gradation value, turning-on of the light-emitting unit 51, and control on the gradation value on the assumption that both the gradation value control and the turning-on are performed. Which operation is to be performed is determined based on reflection luminance $U_1$ required for output from another unit pixel 45 that shares the light-emitting unit 51. Let us assume a case where a first unit pixel 45 that requires the reflection luminance $U_a$ for output and a second unit pixel 45 that requires the reflection luminance $L_a$ for output are both under the influence of a single light-emitting unit 51, for example. In this case, because the light-emitting unit 51 is turned on for the second unit pixel 45 that requires the reflection luminance $L_a$, the first unit pixel 45 that requires the reflection luminance $U_a$ is controlled to perform output of the gradation value T. By contrast, let us assume a case where only the unit pixels 45 that require reflection luminance of equal to or lower than the reflection luminance $U_a$ are under the influence of a single light-emitting unit 51. In this case, by controlling the gradation values of the unit pixels 45 individually, it is possible to cause the unit pixels 45 to provide the reflection luminance required for output without turning on the light-emitting unit 51.

As illustrated in FIG. 9, let us assume a case where reflection luminance $U_b$ is obtained without controlling output (gradation value) of the pixel 48 because the external light intensity is too high with respect to the predetermined reflection luminance $L_a$. In this case, the gradation characteristics of the unit pixel 45 are turned into gradation characteristics $P_3$. As illustrated in FIG. 10, when the reflection luminance $U_b$ is higher than the predetermined reflection luminance $L_a$, the gradation characteristics $P_3$ are deviated from the gradation characteristics $P_2$ at the predetermined reflection luminance $L_a$. In this case, the signal processing unit 80 applies gain to the output from the unit pixel 45 such that the output is reduced by a surplus $L_d$ in the external light intensity, thereby lowering the reflectance in the display region. Thus, the signal processing unit 80 can lower the reflection luminance to the predetermined reflection luminance $L_a$. "To lower the reflectance" means to reduce the intensity of the reflected light RL by reducing the gradation value of the unit pixel 45 to lower the light transmittance of the reflective display elements (e.g., the pixels 48 included in the unit pixel 45). Specifically, as illustrated in FIG. 10, the signal processing unit 80 applies gain, for example, thereby adjusting and lowering the reflection luminance corresponding to the gradation value in the unit pixel 45 compared with the gradation characteristics $P_3$ with no gain applied. Thus, the gradation characteristic $P_2$ at the predetermined reflection luminance $L_a$ can be obtained.

As described above, the signal processing unit 80 performs control on the operation of the light-emitting unit 51, control on the output (gradation value) of each pixel 48, or both of the control. Thus, the display panel 30 can display an image at the predetermined reflection luminance $L_a$.

Figure 11:
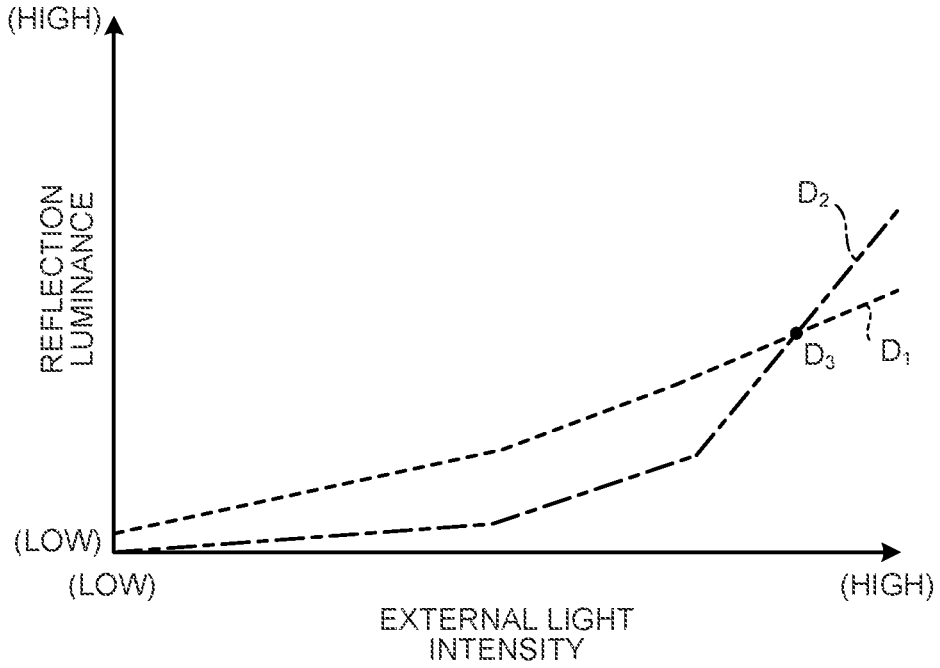
FIG. 11 is a graph illustrating an example of the correspondence relation between reflection luminance and exemplary luminance with respect to the external light intensity.

FIG. 11 is a graph illustrating an example of the correspondence relation between reflection luminance $D_1$ and exemplary luminance $D_2$ with respect to the external light intensity. As indicated by the exemplary luminance $D_2$ illustrated in FIG. 11, for example, an example of reflection luminance (referred to as exemplary luminance) at which the user feels the screen to be easy to view varies depending on the external light intensity. This is because the output from the display unit 10 looks relatively brighter as the environment is darker. The signal processing unit 80 may control the exemplary luminance $D_2$ variably depending on the external light intensity as illustrated in FIG. 11 even if the brightness of the screen set by the user who uses the electronic apparatus 1 is settings under the condition of the specific external light intensity. By defining the exemplary luminance $D_2$ as the "predetermined reflection luminance $L_a$", the electronic apparatus 1 can perform display output with the brightness of the screen corresponding to the external light intensity. Naturally, the signal processing unit 80 may perform control so as to maintain the luminance set by the user independently of the external light intensity.

The output from the display unit 10 becomes brighter as the external light intensity becomes higher. When the external light intensity exceeds a certain threshold (e.g., external light intensity corresponding to the intersection $D_3$ between the reflection luminance $D_1$ and the exemplary luminance $D_2$ illustrated in FIG. 11), the exemplary luminance $D_2$ is higher than the reflection luminance $D_1$. Under the environment where an external light intensity of equal to or higher than the threshold is obtained, the signal processing unit 80 does not turn on the light-emitting unit 51. By contrast, under the environment where the external light intensity is lower than the threshold, the signal processing unit 80 turns on the light-emitting unit 51.

Figure 12:
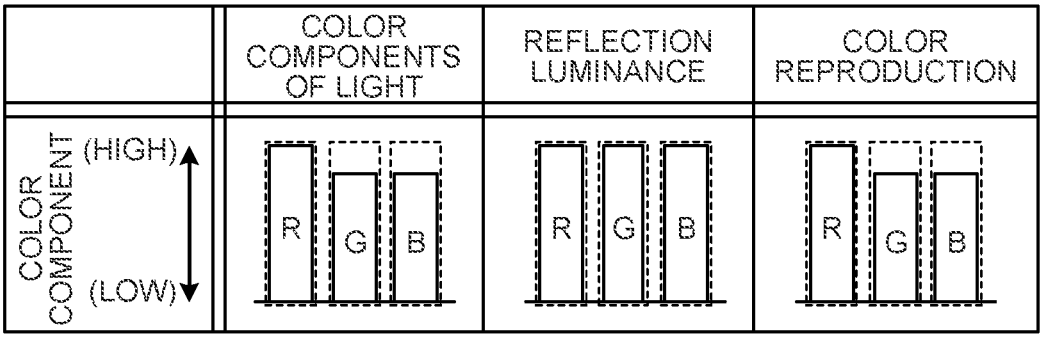
FIG. 12 is a diagram of an example of the correspondence relation between color components of light and color reproduction performed by the display device.
Figure 13:
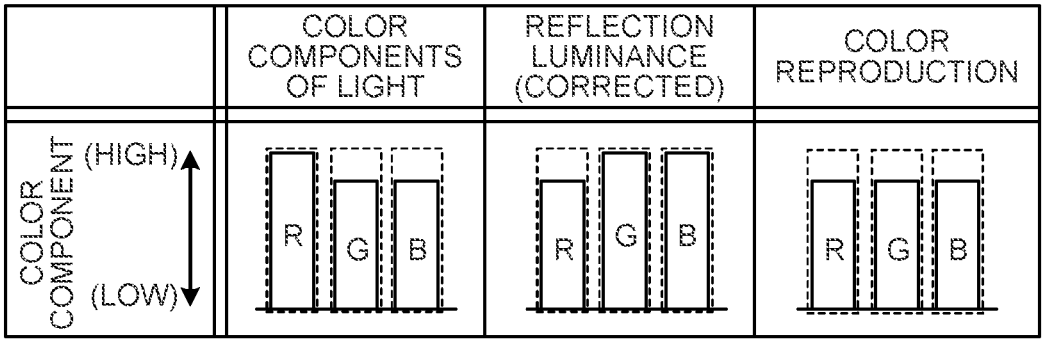
FIG. 13 is a diagram of an example of the correspondence relation between deviation in the color components of light, correction of an output signal, and color reproduction performed by the display device.

FIG. 12 is a diagram of an example of the correspondence relation between color components of light and color reproduction performed by the display device. FIG. 13 is a diagram of an example of the correspondence relation between deviation in the color components of light, correction of an output signal, and color reproduction performed by the display device. In FIGS. 12 to 14, FIGS. 16 to 18, FIG. 20 and FIG. 24, the broken-line frames indicate the largest gradation value (255) expressed by 8-bits. When the output signal is not corrected, the display device performs color reproduction based on the panel characteristics of the display panel 30 and deviation in the color components of light. Specifically, in a case, for example, where the color components of R, G, and B included in light (e.g., the external light $L_2$) with which the display panel 30 is irradiated have deviation and where the degree of reflection of these color components on the display panel 30, that is, the transmittance of light through the reflective display elements is uniform as illustrated in FIG. 12, the display device performs color reproduction based on the deviation in the color components of light. This means that the color reproduction depends on the deviation in the color components of light. Specifically, light emitted from an external light source, such as an incandescent light bulb, placed around the electronic apparatus 1 corresponds to the light in which the color component of R has relatively higher intensity than those of the color components of G and B indicated by the "color components of light" in FIGS. 12 and 13. Based on the light, the reflective display elements perform display output at the highest transmittance such that the entering light L is reflected in the normal white display state ((R,G,B)=(255,255,255)) as indicated by the "reflection luminance" in FIG. 12. As a result, the relation of magnitude in the "color components of light" is expressed as the output of white without any change as indicated by the "color reproduction" in FIG. 12. To address this, the display device corrects the gradation values of the output signal so as to correct the deviation in the color components of light as indicated by the "reflection luminance (corrected)" in FIG. 13. Thus, the display device can reduce the influence of the deviation in the color components of light in color reproduction as indicated by the "color reproduction" in FIG. 13. Specifically, the display device converts the ratio of the color components of R, G, and B included in light into numerical form and corrects the gradation values of the pixel 48 corresponding to the respective color components by multiplying the gradation values by the reciprocal of the numerical ratio, for example. Thus, the display device can perform color reproduction independently of the deviation in the color components of light.

Figure 14:
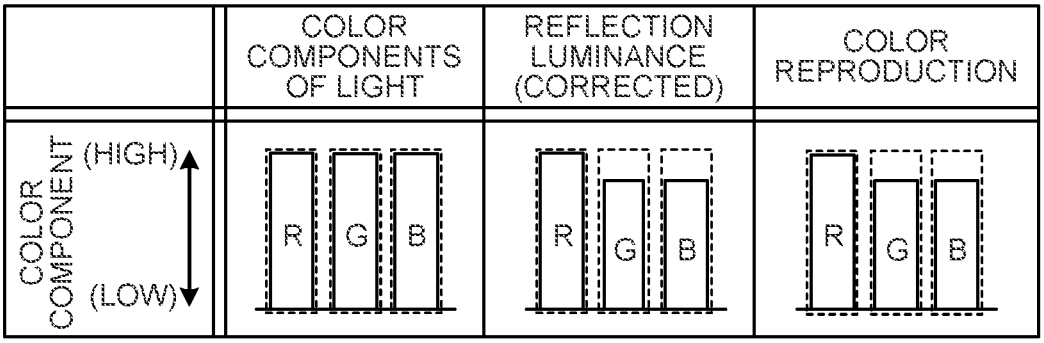
FIG. 14 is a diagram of an example where the color reproduction is performed by the display device in a manner corresponding to the ratio of color components contained in specific external light.

FIG. 14 is a diagram of an example where the color reproduction is performed by the display device in a manner corresponding to the ratio of color components contained in the specific external light $L_2$ when the color components of the external light $L_2$ have no deviation. In the description with reference to FIG. 13, the correction is performed to reduce the influence of the deviation in the color components contained in the external light $L_2$. By contrast, as illustrated in FIG. 14, the display device, for example, may perform color reproduction in a manner corresponding to the ratio of color components contained in light having a specific ratio of color components. Specifically, under the condition where the display panel 30 is irradiated with the external light $L_2$ alone (refer to FIG. 12), the display device does not correct the gradation values. By contrast, under the condition where the display panel 30 is irradiated with light having a ratio of color components different from that of the external light $L_2$, the display device corrects the gradation values of the output signal. In the correction, the display device corrects the reflection luminance of each pixel such that the ratio of color components is the same as that of the external light $L_2$. Thus, the display device can perform color reproduction in a manner corresponding to the ratio of color components contained in the external light $L_2$ (refer to FIG. 14). The signal processing unit 80 of the display device may perform the same control as that in the example illustrated in FIG. 14 not only on the external light $L_2$ but also on light to be emitted from one or a plurality of desired light sources. The light with which the display panel 30 is irradiated is not necessarily emitted from a single light source and may be mixed light emitted from a plurality of light sources. The display panel 30 may be irradiated with both the external light $L_2$ and light from the front light (internal light $L_1$), for example. In this case, the signal processing unit 80 applies a correction formula to the gradation values of the output signal, thereby performing desired color reproduction. The correction formula takes into consideration the ratios of color components and the ratios of the intensities of the internal light $L_1$ and the external light $L_2$.

While the description has been made of display output of white with reference to FIGS. 6 to 14 to simplify the description, the same mechanism is also applicable to the control on the gradation values of the respective pixels 48 constituting the unit pixel 45 in output of other colors.

The intensity of light according to the embodiment is represented by a numerical value of equal to or larger than 0. In addition, the intensity that provides reflection luminance corresponding to the gradation value indicated by the output signal for the pixel 48 in the display unit 10 is set at 1. Specifically, 1 denotes the intensity of light that can cause output of a pixel 48 (e.g., a sub-pixel) for a certain color controlled with a gradation value of 255, for example, to be performed at the luminance indicated by a gradation value of 255. In other words, in a case where the intensity of light is 1, the highest luminance provided by the light is the upper limit of the number of bits (e.g., 255 in the case of 8-bits) of the gradation value indicated by the output signal.

Figure 15:
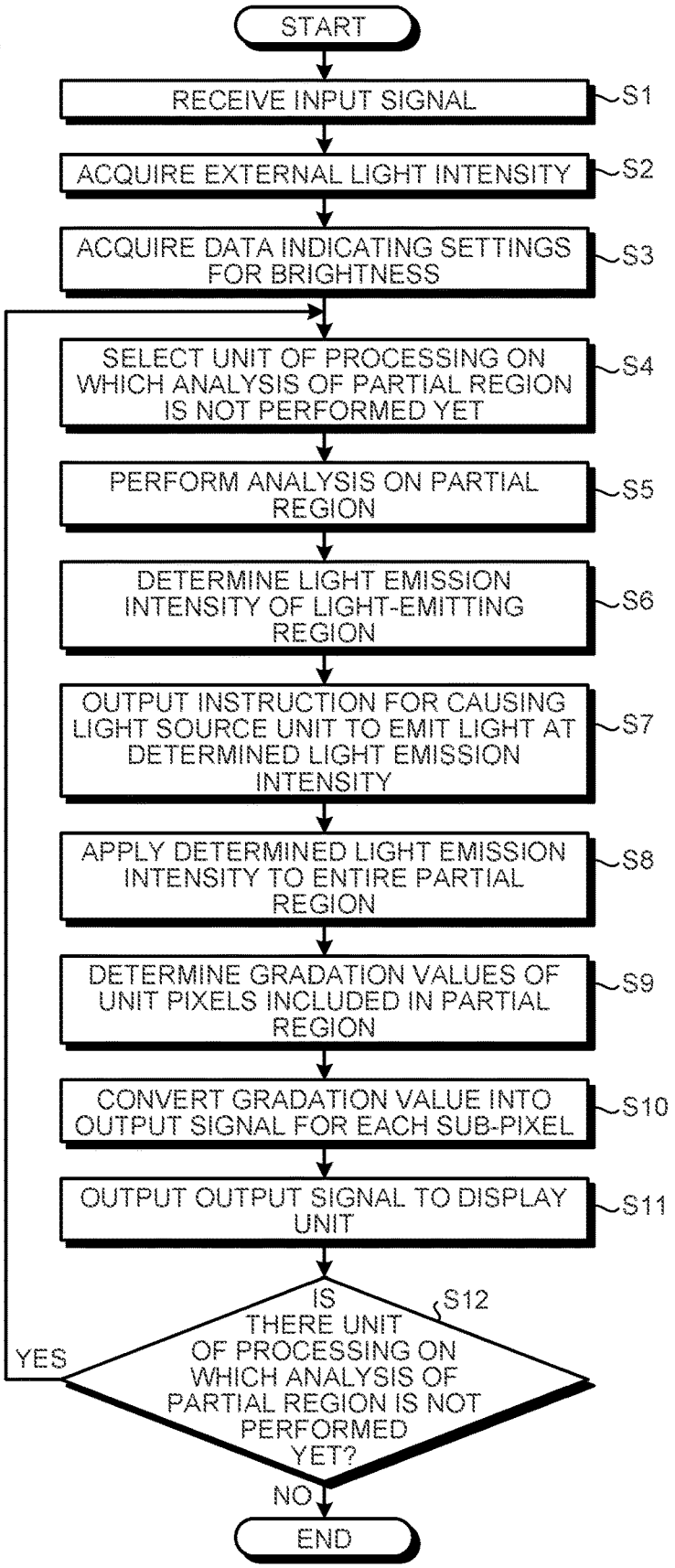
FIG. 15 is a flowchart of an example of processing for display output of one frame performed by a signal processing unit.

FIG. 15 is a flowchart of an example of processing for display output of one frame performed by the signal processing unit 80. If the signal processing unit 80 receives an input signal (Step S1), the signal processing unit 80 acquires the external light intensity measured by the sensor Sen (Step S2). The signal processing unit 80 also acquires data indicating the settings for the brightness (Step S3). In a case where the user makes the settings for the brightness of the screen, for example, the data indicating the settings for the brightness reflects the settings made by the user. By contrast, in a case where the user makes no settings for the brightness of the screen, the data indicating the settings for the brightness reflects predetermined default settings. While the default settings, for example, are settings for providing the reflection luminance at which the user who views the display unit 10 statistically feels the screen to be easy to view, this is given by way of example only. The default settings are not limited thereto and may be appropriately changed. The processing from Step S1 to Step S3 may be performed in random order or in parallel. While the data indicating the settings is stored in a storage unit included in the signal processing unit 80, for example, this is given by way of example of a specific method for storing the settings. The method is not limited thereto and may be appropriately changed. The data indicating the settings may be stored in a storage unit of the control device 100, for example, or a dedicated storage device may be provided to store therein the data indicating the settings.

After the processing from Step S1 to Step S3, the signal processing unit 80 selects one unit of processing on which an analysis of a partial region is not performed yet (Step S4). The signal processing unit 80 performs an analysis on the partial region in the unit of processing selected at Step S4 (Step S5). The analysis is performed based on the gradation values and the settings for the brightness indicated by the input signal for each of the unit pixels 45 in one partial region. Especially in the present embodiment, the analysis is processing for identifying the pixel 48 that performs output at the highest brightness in the partial region. Based on the result of processing at Step S5, the signal processing unit 80 determines the light emission intensity of the light-emitting region in the unit of processing selected at Step S4 (Step S6). The signal processing unit 80 outputs, to the lighting unit 20, an instruction (light-emitting region control signal) for causing the light-emitting region in the partial region selected at Step S4 to emit light at the light emission intensity determined at Step S6 (Step S7). The brightness of the front light and the degree of expansion in each pixel resulting from the processing at Step S7 are uniformly applied to the entire partial region including the pixel that performs output with the highest brightness (Step S8).

Based on the input signal received at Step S1 and the result of processing performed at Step S6, the signal processing unit 80 determines the gradation values (e.g., R, G, and B) of the unit pixels 45 included in the partial region in the unit of processing selected at Step S4 (Step S9). The signal processing unit 80 converts the gradation values determined at Step S9 into an output signal (e.g., an output signal of R, G, or B) for each sub-pixel (Step S10) and outputs it to the display unit 10 (Step S11). The processing at Step S7 and the processing from Step S9 to Step S11 may be performed in random order or in parallel. The processing at Step S7 and the processing at Step S11 are preferably performed simultaneously. Even if a temporal difference is present between the processing at Step S7 and the processing at Step S11, the difference is preferably short enough for the user who views display output performed by the display device not to recognize it.

The signal processing unit 80 determines whether there is a unit of processing on which the analysis of the partial region is not performed yet (Step S12). If the signal processing unit 80 determines that there is a unit of processing on which the analysis of the partial region is not performed yet (Yes at Step S12), the signal processing unit 80 performs the processing at Step S4 again. By contrast, if the signal processing unit 80 determines that there is no unit of processing on which the analysis of the partial region is not performed yet (No at Step S12), the signal processing unit 80 terminates the processing for display output of one frame.

The following serially describes setting of a white point based on the result of measurement of external light (to Step S2), determination of the intensity of the internal light $L_1$ in each unit of processing based on the intensity of external light and magnification (N) of luminance (to Step S7), and adjustment of the gradation values of the pixels 48 based on the intensity of the external light and the internal light $L_1$ (to Step S10) with reference to FIGS. 16 to 20. FIG. 16 is a diagram of an example of setting of a white point. As illustrated in FIG. 16, for example, white is defined as (R,G,B)=(255,255,255) using the gradation values of the RGB signal indicated by the input signal. The ratio of the color components in the definition of white is R:G:B=1:1:1. To set the ratio of color components constituting white in the output from the display device to R:G:B=1:0.8:0.8, the signal processing unit 80 performs correction by multiplying the gradation values of G and B included in the RGB signal indicated by the input signal by 0.8. Thus, the gradation values of the RGB signal becomes (R,G,B)=(255,204,204), for example. In other words, the white point indicates the ratio of a plurality of colors constituting white that is reproduced by the combination of the colors. The signal processing unit 80 corrects the gradation values of the respective colors such that white (e.g., (R,G,B)=(255,255,255)) indicated by the input signal agrees with the ratio of the colors defined by the white point.

By contrast, in a case where the ratio of color components of the external light $L_2$ is R:G:B=1:0.8:0.8, the signal processing unit 80 corrects the input signal as described with reference to FIG. 16. Thus, the display device can perform the same color reproduction as that performed under the illumination of the external light L2 alone even if the color reproduction is performed under the illumination of light (e.g., the internal light $L_1$ alone) having a ratio of color components of R:G:B=1:1:1. As described above, the display device corrects the input signal based on color reproduction for a predetermined color (e.g., white), making it possible to desired color reproduction. While white is defined by the ratio of color components of the external light $L_2$ with reference to FIG. 16 in the above description, white is not necessarily defined by the ratio of color components of the external light $L_2$ and may be defined arbitrarily. White in the RGB signal indicated by the input signal is not necessarily defined by (R,G,B)=(255,255,255) and may be appropriately changed. The signal processing unit 80 corrects the input signal according to the difference between the ratio of color components of the input signal and the ratio (white point) of color components constituting white to be a target in the output from the display device. The signal processing unit 80 may correct the input signal using the white point with a mechanism of color management (e.g., the 3×3 matrix expressed by Equation (2)). In Equation (2), the left-hand side indicates the white point, the matrix (R,G,B) on the right-hand side indicates the gradation values of the input signal (RGB signal), and the coefficient represented by the 3×3 matrix indicates the coefficient for correction. The color serving as a reference for correction of the gradation values may be a desired color other than white.

$$\begin{pmatrix} R' \\ G' \\ B' \end{pmatrix} = \begin{pmatrix} a11 & a12 & a13 \\ a21 & a22 & a23 \\ a31 & a32 & a33 \end{pmatrix} \begin{pmatrix} R \\ G \\ B \end{pmatrix} \tag{2}$$

While the RGB signal according to the embodiment is expressed by values of 8-bits, this is given by way of example only, and the RGB signal is not limited thereto. A specific aspect, such as the number of bits of the RGB signal, may be appropriately changed. The number of bits may be larger than 8-bits, such as 16-bits, or may be smaller than 8-bits, such as 4-bits.

The following describes the analysis performed at Step S5 and correction of the brightness in the output. FIG. 17 is a diagram of an example where the input signal is corrected using the white point and the magnification of luminance. To multiply the luminance of the color that is reproduced by the RGB signal indicated by input signal by N times (e.g., N=2) in the output from the display device, for example, the signal processing unit 80 performs the processing illustrated in FIG. 17. Specifically, the signal processing unit 80 multiplies the gradation values of the RGB signal indicated by the input signal by the correction value corresponding to the white point and by the value (N) indicating the magnification of the luminance, thereby deriving a required luminance value. The required luminance value includes information on the ratio of colors (e.g., R, G, and B) required for output and information on the luminance of each color.

In the description with reference to FIGS. 17 to 22, the external light intensity is (R(OL),G(OL),B(OL))=(1,0.8,0.8), and the ratio of color components indicated by the white point determined based on the external light intensity is R:G:B=255:204:204, for example. In other words, the white point is set to reproduce white that is visually recognized when display output of (R,G,B)=(255,255,255) is performed under the environment with the external light $L_2$ alone. The setting of the white point is given by way of example only and is not limited thereto. The setting may be appropriately changed. The white point, for example, may be set independently of the external light $L_2$.

The signal processing unit 80 according to the embodiment determines N based on the external light intensity measured by the sensor Sen. Specifically, the signal processing unit 80, for example, determines N to be a value corresponding to the ratio between the reflection luminance and the optimum luminance illustrated in FIG. 11. In a case where the sensor Sen measures external light intensity having reflection luminance of ½ as high as the exemplary luminance, for example, the signal processing unit 80 determines N to be 2. By determining N to be the reciprocal of (reflection luminance/exemplary luminance), the signal processing unit 80 can correct the input signal based on the external light intensity. The upper limit of N according to the embodiment depends on the ratio between the external light intensity and the internal light intensity and on the upper limit of the internal light intensity. The value (N) indicating the magnification of luminance may be a desired real number that is larger than 0 (N>0) and independent of the external light intensity.

Let us assume a case where the input signal indicates (R,G,B)=(180,225,80) as illustrated in FIG. 17, for example. If the external light intensity is (R(OL),G(OL),B(OL))=(1, 0.8,0.8), and the ratio of color components indicated by the white point determined based on the external light intensity is R:G:B=255:204:204, the signal processing unit 80 multiplies the gradation value of R by 1 and multiplies the gradation values of G and B by 0.8 as the correction value based on the white point as indicated by the "white point" in FIG. 17. The signal processing unit 80 also multiplies the gradation values of the respective colors by a value corresponding to the magnification (N) (e.g., N=2) of luminance as indicated by the "magnification (N) of luminance" in FIG. 17. In the example illustrated in FIG. 17, a required luminance value of (Rt,Gt,Bt)=(360,360,128) is calculated.

FIG. 18 is a diagram of an example of calculation of to-be-added luminance. As illustrated in FIG. 17, the required luminance value may possibly exceed the upper limit of the gradation value reproducible only by the external light $L_2$ depending on the value (N) indicating the magnification of luminance. In this case, to perform output corresponding to the gradation value exceeding the upper limit in the required luminance value, the signal processing unit 80 performs processing for providing the internal light $L_1$ corresponding to the output of the gradation value exceeding the upper limit. Specifically, as illustrated in FIG. 18, the signal processing unit 80 subtracts, from the required luminance value, the highest luminance of color components that can be displayed by the external light $L_2$, for example. The signal processing unit 80 determines luminance depending on the luminance of remaining color components (to-be-added luminance) to be the color components of the luminance to be compensated with the internal light $L_1$. More specifically, the signal processing unit 80 calculates the output from the light-emitting region to compensate for the luminance deficiency of each color component, that is, the intensity of the internal light $L_1$ to be emitted from the light-emitting unit 51 provided to the light-emitting region using the following Equations (3) to (5). The intensity of the internal light $L_1$ is represented by a value of equal to or larger than 0, for example. An intensity of 0 indicates that the light-emitting region is turned off, and a predetermined largest value (e.g., 1) indicates that the light-emitting region is turned on at the maximum output. When the intensity of the internal light $L_1$ required to compensate for the luminance deficiency exceeds 0 in any one of the color components, the light-emitting region needs to be turned on. The signal processing unit 80 performs processing for turning on the light-emitting unit 51 based on the highest intensity of the calculated intensities of the internal light $L_1$ for the respective color components. The intensity (FLMAX) of the highest internal light $L_1$, for example, is calculated using the following Equation (6). The left-hand sides (R(FL), G(FL), and B(FL)) of Equations (3), (4), and (5) indicate the intensities of the internal light $L_1$ required for reproduction of the color components R, G, and B, respectively. Rf, Gf, and Bf in Equations (3), (4), and (5), respectively, indicate the values of the to-be-added luminance (refer to FIG. 18). FL(r), FL(g), and FL(b) in Equations (3), (4), and (5) indicate the luminance values of R, G, and B, respectively, compensated for when the light-emitting region is turned on at the maximum output. In the embodiment, the color components of light (internal light $L_1$) output from the light-emitting region is expressed by R:G:B=1:1:1, and FL(r)=FL(g)=FL(b)=255 is satisfied. This is given by way of example only, and the output characteristics of the light-emitting region are not limited thereto. FL(r), FL(g), and FL(b) are determined based on the color components and the maximum output of light that is emitted from the light-emitting region.

$$R(FL)=Rf/FL(r) \tag{3}$$

$$G(FL)=Gf/FL(g) \tag{4}$$

$$B(FL)=Bf/FL(b) \tag{5}$$

$$FL\mathrm{MAX}=\mathrm{MAX}\{R(FL),G(FL),B(FL)\} \tag{6}$$

Let us assume a case where the required luminance value is (Rt,Gt,Bt)=(360,360,128) (refer to FIGS. 17 and 18), and the largest value of the reflection luminance generated by the external light $L_2$ is (R,G,B)=(255,204,204), for example. By subtracting the largest value of the reflection luminance generated by the external light $L_2$ from the required luminance value, (R,G,B)=(105,156,0) is obtained (refer to FIG. 18) where a value smaller than 0 is assumed to be 0. The gradation values of the respective colors obtained by the calculation correspond to the to-be-added luminance (Rf, Gf,Bf).

By substituting the to-be-added luminance illustrated in FIG. 18 and the luminance values of R, G, and B (FL(r) =FL(g)=FL(b)=255) compensated for when the light-emitting region is turned on at the maximum output according to the embodiment in Equations (3), (4), and (5), R(FL)=0.41, G(FL)=0.61, and B(FL)=0, respectively, are obtained. In this case, 0.61 of G(FL) is the largest of R(FL), G(FL), and B(FL). Based on Equation (6), FLMAX=0.61 is obtained. While the signal processing unit 80 according to the embodiment rounds off the fractions obtained by the calculation to two decimal places, any desired method may be employed to process the fractions.

Let us assume a case where, by applying a value corresponding to the magnification (N) of luminance (e.g., N=2) to the gradation value T illustrated in FIG. 8, a gradation value $T_2$ is calculated, for example. The gradation value T can be output only by the external light $L_2$. Thus, to output the gradation value T, the external light $L_2$ alone is required. The gradation value $T_2$ is larger than the gradation value T. Thus, to output the gradation value $T_2$, addition of the internal light $L_1$ is required besides the external light $L_2$. In this case, the difference between the intensity of light required in order to output the gradation value $T_2$ and the external light intensity (e.g., the difference between the reflection luminance $U_a$ and the reflection luminance $L_a$) corresponds to the to-be-added luminance.

The embodiment controls the intensity of light (internal light $L_1$) emitted from the light-emitting region in each unit of processing. Thus, the intensity of the internal light $L_1$ required in each unit of processing needs to provide the luminance corresponding to the output from the unit pixel 45 that performs output with the highest luminance out of the unit pixels 45 included in the partial region in the unit of processing. The signal processing unit 80 calculates the required luminance and the highest intensity (FULMAX) of the internal light $L_1$ using Equations (3) to (6) for each of the unit pixels 45 included in one partial region. The signal processing unit 80 employs the largest FLMAX of the FLMAXs calculated for the respective unit pixels 45 as the intensity (IL) of the internal light $L_1$ in the unit of processing including the partial region. The processing described above corresponds to the analysis. In other words, the analysis performed by the signal processing unit 80 is processing for calculating the required luminance value for the luminance value of a pixel 48 to be N times (N>0) as high as the luminance value indicated by the input signal, the pixel 48 performing output with the largest gradation value out of the pixels 48 included in a predetermined image display region (e.g., one partial region). To calculate the to-be-added luminance in the analysis, the signal processing unit 80 determines the intensity of the internal light $L_1$ based on the result of comparison between the external light intensity and the required luminance value (e.g., the result obtained by subtracting the upper limit of the gradation value reproducible only by the external light $L_2$ from the required luminance value).

The intensity (IL) of the internal light $L_1$ indicates the internal light intensity in one unit of processing. The analysis is processing for determining the internal light intensity, that is, the intensity of light (internal light $L_1$) emitted from one light-emitting region. The signal processing unit 80 defines the intensity of the internal light $L_1$ as the light emission intensity in the light-emitting region in the unit of processing. The signal processing unit 80 outputs, to the light-source-unit control circuit 60, a light-emitting region control signal serving as an instruction for the light-emitting region to emit light at the internal light intensity.

FIG. 19 is a diagram of an example of processing for deriving the intensity of the internal light $L_1$ for each unit of processing. In FIG. 19, the gradation values taking the largest value in the respective colors are hatched in each unit of processing. As illustrated in FIG. 19, the required luminance values (Rt,Gt,Bt) of the respective unit pixels 45 included in the partial region of a unit of processing $U_1$ are (360,360,128), (300,300,100), (200,200,50), (100,100,25), (50,50,0) . . . . In the partial region of the unit of processing $U_1$, a required luminance value of (Rt,Gt,Bt)=(360,360,128) in a signal unit pixel 45 has the largest values of the required luminance values (Rt) of R, the required luminance values (Gt) of G, and the required luminance values (Bt) of B. As a result, the signal processing unit 80 employs FLMAX (0.61), which is calculated based on the required luminance value (Rt,Gt,Bt)=(360,360,128) of the unit pixel 45, as the intensity of the internal light $L_1$. In other words, the intensity of the internal light $L_1$ is determined based on the unit pixel 48 having a gradation value that most requires the addition of the internal light $L_1$ in one partial region. The intensity is determined independently of lower gradation values of the other pixels 48 included in the partial region.

The required luminance values (Rt,Gt,Bt) of the respective unit pixels included in the partial region of a unit of processing $U_2$ are (360,250,100), (300,360,100), (100,100,128), (100,100,25), (50,50,0) . . . . In the partial region of the unit of processing $U_2$, the unit pixel 45 having a required luminance value of (360,250,100) has the largest required luminance value of R (Rt=360). The unit pixel 45 having a required luminance value of (300,360,100) has the largest required luminance value of G (Gt=360). The unit pixel 45 having a required luminance value of (100,100,128) has the largest required luminance value of B (Bt=128). In this case, to calculate the intensity of the internal light $L_1$, the signal processing unit 80 employs the largest values of the required luminance values of the respective colors indicated by the required luminance values of the unit pixels 45. In this example, FLMAX of the unit pixel 45 having (Rt=360) is 0.41, FLMAX of the unit pixel 45 having (Gt=360) is 0.61, and FLMAX of the unit pixel 45 having (Bt=128) is 0. Therefore, the signal processing unit 80 determines the intensity of the internal light $L_1$ in the unit of processing $U_2$ to be 0.61. As described above, the required luminance value for deriving the intensity of the internal light $L_1$ is determined for each unit of processing based on the required luminance values of the respective unit pixels 45 included in one unit of processing. The signal processing unit 80 derives the intensity of the internal light $L_1$ for each unit of processing. Based on the derived intensity of the internal light $L_1$ and the external light intensity, the signal processing unit 80 calculates the intensity of the internal light $L_1$.

The signal processing unit 80 according to the embodiment calculates the FLMAXs of all the unit pixels included in units of processing individually and identifies the largest FLMAX for each unit of processing. Thus, the signal processing unit 80 determines the identified largest FLMAX to be the intensity of the internal light $L_1$. The detail of this processing is omitted in the above description with reference to FIG. 19.

The signal processing unit 80 of the embodiment calculates the FLMAXs of the respective unit pixels 45 and then determines the largest FLMAX for each unit of processing to be the intensity of the internal light $L_1$. Alternatively, the signal processing unit 80 of the embodiment may identify the largest gradation value of the colors constituting the unit pixel 45 in each unit of processing, calculate FLMAX to output the identified largest gradation value of the colors, and determine the FLMAX to be the intensity of the internal light $L_1$. In this example, the signal processing unit 80 calculates the intensity (FLMAX=0.61) of the internal light $L_1$ based on the to-be-added luminance (Rf,Gf,Bf)=(105,156,0) calculated based on the required luminance value (Rt,Gt,Bt)=(360,360,128) for both the units of processing $U_1$ and $U_2$.

FIG. 20 is a diagram of an example of an arithmetic operation for determining an output signal. The signal processing unit 80 corrects the required luminance value on the assumption of an increase in the luminance caused by light from the light-emitting region turned on based on the highest intensity of the internal light $L_1$. Specifically, the signal processing unit 80 corrects the required luminance value using the following Equations (7) to (9), thereby determining gradation values (O(R), O(G), O(B)) indicated by an output signal to each sub-pixel constituting the unit pixel 45. Rt, Gt, and Bt in Equations (7), (8), and (9) denote the color components of R, G, and B, respectively, indicated by the required luminance value. R(OL), G(OL), and B(OL) in Equations (7), (8), and (9), respectively, denote the intensity secured by the external light $L_2$. R(IL), G(IL), and B(IL) in Equations (7), (8), and (9), respectively, denote the intensity secured by light (internal light $L_1$) emitted from the light-emitting region, that is, the intensity of the internal light $L_1$. Specifically, R(IL), G(IL), and B(IL) correspond to the largest FLMAX in the unit of processing.

$$O(R)=Rt/(R(OL)+R(\mathrm{IL})) \tag{7}$$

$$O(G)=Gt/(G(OL)+G(\mathrm{IL})) \tag{8}$$

$$O(B)=Bt/(B(OL)+B(\mathrm{IL})) \tag{9}$$

As indicated by Equations (7) to (9), the signal processing unit 80 of the display device calculates output gradation values of the respective pixels 48 based on Equation (1) where OL denotes the external light intensity, IL denotes the intensity of the internal light $L_1$, I denotes the gradation value indicated by the input signal, and O denotes the output gradation value of the pixel 48. When IL>0 is satisfied, the signal processing unit 80 according to the embodiment calculates the required luminance value under the condition that the output gradation value of the pixel 48 that performs output with the largest gradation value out of the pixels 48 included in a predetermined image display region (e.g., one partial region) is defined as a gradation value that makes the light transmittance maximum. Specifically, in the example illustrated in FIG. 20, G is the color of light employed as the intensity (IL) of the internal light $L_1$ in the unit of processing, that is, the color the light intensity of which most requires the addition of the internal light $L_1$. Thus, the sub-pixel 48G for G in the unit pixel 45 the light intensity of which most requires the addition of the internal light $L_1$ performs output at the largest gradation value (255). By controlling the gradation value in this manner, the display device can achieve both minimizing the addition of the internal light $L_1$ and securing desired luminance.

The following Equations (10) to (12) are obtained by substituting the example illustrated in FIG. 20 in Equations (7) to (9), respectively. Let us assume a case where FLMAX=0.61, which is obtained based on the to-be-added luminance (Rf,Gf,Bf)=(105,156,0) in FIG. 18, is employed as the intensity (IL) of the internal light $L_1$, for example. In other words, the intensity of the internal light $L_1$ is expressed by (R(IL),G(IL),B(IL))=(0.61,0.61,0.61). In a case where the external light intensity is expressed by (R(OL),G(OL),B(OL))=(1,0.8,0.8), the internal light $L_1$ of (R(IL),G(IL),B(IL))=(0.61,0.61,0.61) is added to the external light intensity of each color component. The intensity of light of red in the entering light L, which corresponds to "(R(OL)+R(IL))" in Equation (7), is "1.61" as indicated in Equation (10). The intensity of light of green in the entering light L, which corresponds to "(G(OL)+G(IL))" in Equation (8), is "1.41" as indicated in Equation (11). The intensity of light of blue in the entering light L, which corresponds to "(B(OL)+B(IL))" in Equation (9), is "1.41" as indicated in Equation (12). The signal processing unit 80 performs output gradation value control for outputting the required luminance value (Rt,Gt,Bt)=(360,360,128) under the condition that the display unit 10 is irradiated with the entering light L having these intensities. Specifically, as indicated by Equations (10) to (12), the signal processing unit 80 divides the required luminance values of the respective colors by the intensities of light of the respective color components in the entering light L. As a result, (O(R),O(G),O(B))=(223,255,91) is obtained as illustrated in FIG. 20.

$$O(R)=360/(1+0.61)=223 \quad (10)$$

$$O(G)=360/(0.8+0.61)=255 \quad (11)$$

$$O(B)=128/(0.8+0.61)=91 \quad (12)$$

A required luminance value of "360" in Equation (10) is a value obtained by multiplying the gradation value indicated by the input signal (R=180) by N (N=2). The signal processing unit 80 calculates the output gradation value based on Equation (1):

$$O=I\times N/(OL+\mathrm{IL}) \quad (1)$$

where OL is the intensity of external light (R(OL)=1), IL is the intensity of internal light (R(IL)=0.61), I is the gradation value indicated by the input signal (R=180), and O is the output gradation value of the pixel (O(R)=223).

A required luminance value of "360" in Equation (11) is a value obtained by performing correction using the white point (0.8) on the gradation value indicated by the input signal (G=225) and multiplying the value resulting from the correction by N (N=2). The signal processing unit 80 calculates the output gradation value based on Equation (1):

$$O=I\times N/(OL+\mathrm{IL}) \quad (1)$$

where OL is the intensity of external light (G(OL)=0.8), IL is the intensity of internal light (G(IL)=0.61), I is the gradation value indicated by the input signal (G=225), and O is the output gradation value of the pixel (O(G)=255).

A required luminance value of "128" in Equation (12) is a value obtained by performing correction using the white point (0.8) on the gradation value indicated by the input signal (B=160) and multiplying the value resulting from the correction by N (N=2). The signal processing unit 80 calculates the output gradation value based on Equation (1):

$$O=I\times N/(OL+\mathrm{IL}) \quad (1)$$

where OL is the intensity of external light (B(OL)=0.8), IL is the intensity of internal light (B(IL)=0.61), I is the gradation value indicated by the input signal (B=160×0.8=128), and O is the output gradation value of the pixel (O(B)=91).

The white point is the ratio of a plurality of colors constituting white that is reproduced by a combination of the colors (e.g., RGB). Therefore, the signal processing unit 80 corrects the gradation value indicated by the input signal using the ratio of the colors constituting white that is reproduced by the combination of the colors and then calculates the output gradation values of the respective pixels based on Equation (1). Although correction using the white point (1) is actually performed in the calculation of Equation (10) on the gradation value indicated by the input signal (R=180), the correction generates no change in the gradation value. As a result, the gradation value is not actually corrected (R=180×1=180).

As described above, the signal processing unit 80 performs calculation of the gradation values indicated by the output signals for the sub-pixels using Equations (7) to (9) on the unit pixels 45 included in the partial region. Thus, the signal processing unit 80 determines the gradation values of the unit pixels 45 included in the partial region of one unit of processing in the same manner of the processing at Step S8.

The signal processing unit 80 performs the same processing as that described above on each unit of processing. Thus, the signal processing unit 80 determines the intensity of the internal light $L_1$ of each of all the light-emitting regions in the light source unit 50. The signal processing unit 80 also determines the gradation values indicated by the output signals for the respective sub-pixels included in each partial region in the display unit 10. As described above, the signal processing unit 80 defines one partial region as a predetermined image display region and calculates the required luminance values of one light-emitting region corresponding to the partial region. The signal processing unit 80 then determines the intensity of the internal light $L_1$ emitted from the one light-emitting region and calculates the output gradation values of the respective pixels 48 included in the one partial region.

FIG. 21 is a diagram of an example of control on the internal light $L_1$ and calculation of the gradation values for each unit of processing. The external light $L_2$ is common to all the units of processing. FIG. 21 illustrates a case where the external light intensity is (R(OL),G(OL),B(OL))=(1,0.8,0.8). In the units of processing $U_1$ and $U_2$ illustrated in FIG. 21, a required luminance value of (Rt,Gt,Bt)=(360,360,128) is obtained based on the input signals for the unit pixels 45 included in the units of processing. As a result, the intensity of the internal light $L_1$ in the units of processing $U_1$ and $U_2$ is "0.61" as described with reference to FIGS. 17 to 20. In a unit of processing $U_3$ illustrated in FIG. 21, a required luminance value of (Rt,Gt,Bt)=(360,128,128) is obtained based on the input signals for the unit pixels 45 included in the unit of processing. In the unit of processing $U_3$, R(FL)

=0.41, G(FL)=0, and B(FL)=0 are satisfied. Therefore, FLMAX=0.41 is obtained, and the intensity of the internal light $L_1$ in the unit of processing $U_3$ is determined to be "0.41". In a unit of processing $U_4$ illustrated in FIG. 21, a required luminance value of (Rt,Gt,Bt)=(200,128,128) is obtained based on the input signals for the unit pixels 45 included in the unit of processing. In the unit of processing $U_4$, R(FL)=0, G(FL)=0, and B(FL)=0 are satisfied. Therefore FLMAX=0 is obtained, and the intensity of the internal light $L_1$ in the unit of processing $U_4$ is determined to be "0". As described above, according to the embodiment, the light-emitting units 51 provided to the respective units of processing can be controlled individually at the intensities of the internal light $L_1$ required for the respective units of processing. While FIG. 21 illustrates the require luminance values and the intensities of the internal light $L_1$ of the four units of processing $U_1$, $U_2$, $U_3$, and $U_4$, the signal processing unit 80 performs the same processing on the other units of processing individually.

Figures 22, 23:
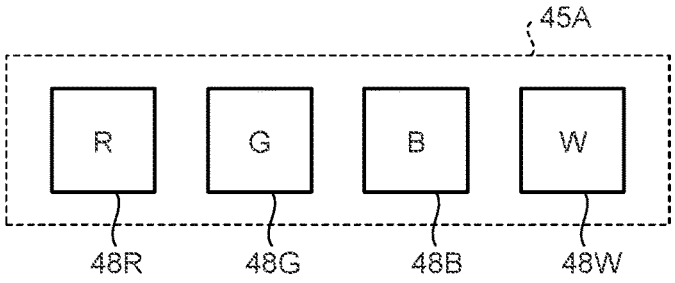
FIG. 22 is a diagram of exemplary calculation of the gradation values of a plurality of unit pixels included in one unit of processing.
FIG. 23 is a diagram of an example of a unit of color reproduction performed by a plurality of pixels serving as sub-pixels according to a modification.

FIG. 22 is a diagram of exemplary calculation of the gradation values of a plurality of unit pixels included in one unit of processing. FIG. 22 illustrates a case where the external light intensity is (R(OL),G(OL),B(OL))=(1,0.8, 0.8). The required luminance values (Rt,Gt,Bt) of the respective unit pixels 45 included in the unit of processing $U_1$ are (360,360,128), (300,300,100), (200,200,50), (100, 100,25), (50,50,0) . . . . Based on these required luminance values, the signal processing unit 80 calculates the gradation values corresponding to the intensity of the entering light L based on the external light intensity of (R(OL),G(OL),B (OL))=(1,0.8,0.8) and the intensity (0.61) of the internal light $L_1$ in the unit of processing $U_1$ using Equations (7) to (9). As illustrated in FIG. 22, the gradation values indicated by the output signals for the unit pixels 45 are (O(R),O(G), O(B))=(223,255,91), (186,213,71), (124,141,35), (62,71, 18), (31,35,0) . . . . While FIG. 22 illustrates the case of the unit of processing $U_1$, the signal processing unit 80 performs the same processing on the other units of processing individually.

A gap between a frame of output (light emission) from the light-emitting region and a frame of output of an image from the display unit 10 is allowed as long as it is short enough for human eyes not to visually recognize it. Let us assume a case where the display device performs output with 60 frames per second (fps), for example, and a timing of light emission by the light-emitting region of the light source unit 50, which is performed based on the intensity of the internal light $L_1$ calculated from the input signal corresponding to the image, is delayed by one frame with respect to a timing of output of the image from the display unit 10. Because the delay cannot be visually recognized by human eyes, it is allowable. The specific values of fps and the number of frames are given by way of example only, and they are not limited thereto. The degree of an allowable gap between the frame of the output timing of the image and the frame of the light emission timing may be appropriately changed depending on the magnitude of fps.

The signal processing unit 80 outputs signals indicating the determined gradation values to the respective sub-pixels as the output signals. The signal processing unit 80 also outputs, to the light-emitting regions, signals for instructing the respective light-emitting regions to emit light at the determined intensities of the internal light $L_1$. The display unit 10 causes each pixel 48 to operate so as to provide the light transmittance corresponding to the gradation value indicated by the output signal. The lighting unit 20 causes the light-emitting regions to light up at the respective light emission intensities corresponding to the instructions.

The embodiment can employ a desired color space by changing the definition of white indicated by the white point, that is, the ratio of the colors constituting white. Specifically, a measurement unit (e.g., the sensor Sen) measures the intensities of color components of a plurality of colors contained in the external light $L_2$. The signal processing unit 80 employs the ratio of the measured intensities of the color components of the colors as the definition of the white point. Thus, a color to be output as white is made to be white that is visually recognized under the illumination condition with the external light $L_2$. In other words, by employing such a white point, the color space in display output performed by the display device is made to be the color space under the illumination condition with the external light $L_2$ independently of the ratio of the colors constituting light with which the display panel 30 is irradiated.

The color space based on the white point is not necessarily defined by the ratio of the intensities of the external light $L_2$ of the respective colors. The signal processing unit 80, for example, may make the ratio of the colors constituting white uniform. Specifically, the signal processing unit 80 may set the ratio of the colors indicated by the definition of the white point to 1:1: . . . :1. Because the internal light $L_1$ according to the embodiment has a ratio of the color components of R, G, and B of 1:1:1, the internal light $L_1$ satisfies the condition described above. By setting the ratio of the colors indicated by the definition of the white point to 1:1:1, the color space in display output is made to be the color space under the illumination condition with the internal light $L_1$ independently of the ratio of the colors constituting light with which the display panel 30 is irradiated.

In the embodiment, when the external light intensity is high enough to perform display output, for example, the internal light $L_1$. may not be possibly used. In a case where the display device is intentionally set to perform darker display output, for example, the external light intensity is more likely to be high enough to perform display output. In a case where the environment around the electronic apparatus 1 including the display device is in total darkness, for example, the external light intensity may possibly be 0.

As described above, according to the embodiment, display output can be performed at the brightness depending on the external light intensity. According to the embodiment, one partial region is defined as a predetermined image display region; the required luminance values of one light-emitting region corresponding to the one partial region is calculated; the intensity of the internal light $L_1$ to be emitted from the light-emitting region is determined; and the output gradation values of the respective pixels 48 included in the partial region are calculated. Thus, it is possible to perform control for causing each light-emitting region to emit light at the intensity of the internal light $L_1$ required for the partial region. When output from a part of the partial regions is bright, it is possible to reduce the quantity of light from a light-emitting region corresponding to another partial region for which addition of the internal light $L_1$ is not required or that is sufficiently irradiated with light at relatively low intensity. Thus, the power consumption can be further reduced.

The pixels 48 each serve as a sub-pixel that outputs any one of a plurality of colors, and the display unit 10 combines output from the sub-pixels, thereby performing color reproduction, for example. Thus, display output can be performed at the brightness corresponding to the external light intensity also in color output.

In the embodiment, the gradation values indicated by the input signal are corrected using the ratio (white point) of a plurality of colors constituting white that is reproduced by the combination of the colors. Thus, color reproduction can be performed in a desired color space.

In the embodiment, the ratio of measured intensities of color components of a plurality of colors is made to be the ratio of the colors constituting white. Thus, color reproduction can be performed under the illumination condition with the external light alone independently of the ratio of the colors constituting light with which the display panel 30 is irradiated.

In the embodiment, the ratio of the colors constituting white is made to be uniform. Even if the ratio of colors constituting light with which the display panel 30 is irradiated is not uniform, color reproduction can be performed in a color space where the ratio of the colors constituting white is uniform.

The pixels 48 each serve as a sub-pixel that outputs any one of the colors of R, G, and B. The display unit 10 combines output from the sub-pixel 48R for R, the sub-pixel 48G for G, and the sub-pixel 48B for B, thereby performing color reproduction based on RGB signals. Thus, it is possible to minimize the load of the conversion of colors in the processing for generating the output signal from the input signal, for example.

When IL>0 is satisfied, the required luminance value is calculated under the condition that the output gradation value of the pixel 48 that performs output with the largest gradation value out of the pixels 48 included in the predetermined image display region is set to a gradation value that makes the light transmittance maximum. Thus, it is possible to achieve both minimizing the addition of the internal light $L_1$ and securing desired luminance.

Modification

The following describes a modification of the present invention. FIG. 23 is a diagram of an example of a unit of color reproduction performed by a plurality of pixels 48 serving as sub-pixels according to the modification. The pixels 48 according to the modification each serve as a sub-pixel that outputs any one of a plurality of colors. The display panel 30 combines output from the sub-pixels, thereby performing color reproduction. Specifically, the pixels 48 according to the modification each serve as a sub-pixel that outputs any one of the colors of red (R), green (G), blue (B), and white (W). The display panel 30 combines output from the sub-pixel 48R for R, the sub-pixel 48G for G, the sub-pixel 48B for B, and a sub-pixel 48W for W, thereby performing color reproduction based on input signals. Instead of the unit pixels 45 according to the embodiment above, the modification includes a plurality of unit pixels 45A each having one sub-pixel 48R for R, one sub-pixel 48G for G, one sub-pixel 48B for B, and one sub-pixel 48W for W.

Figure 24:
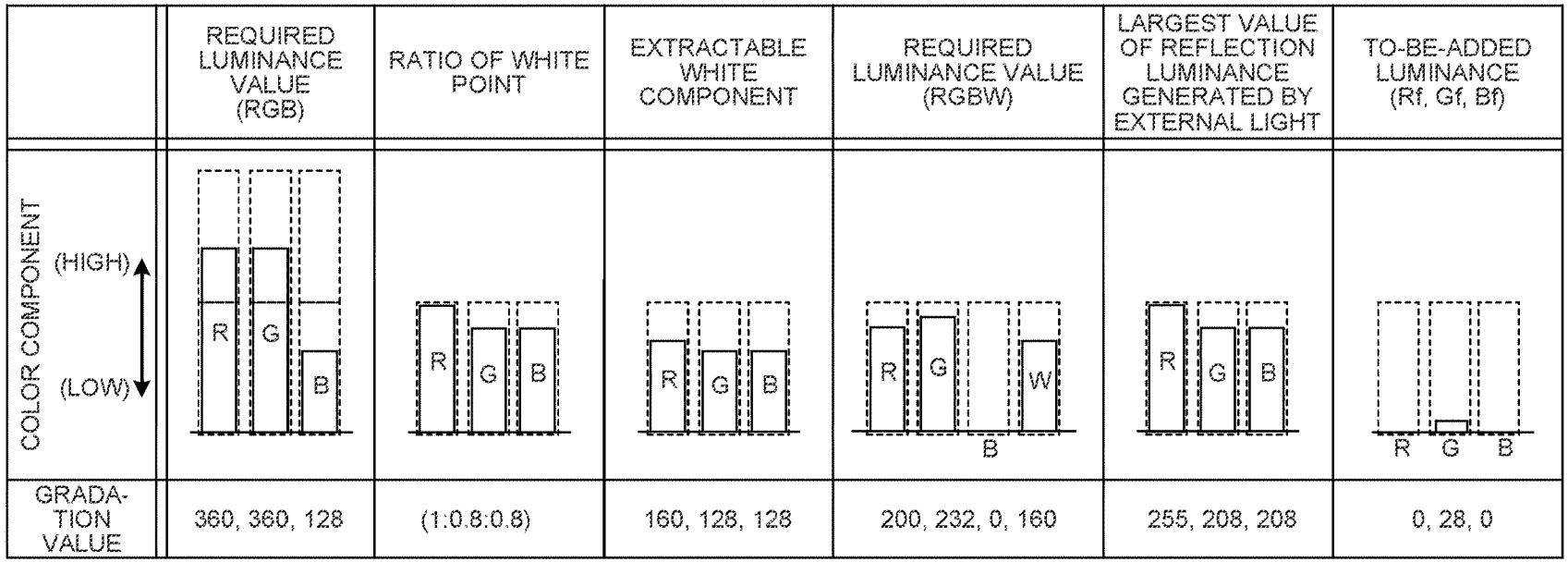
FIG. 24 is a diagram of exemplary calculation of the to-be-added luminance according to the modification.

FIG. 24 is a diagram of exemplary calculation of the to-be-added luminance according to the modification. In the modification, after calculating the required luminance value (refer to FIG. 17) in the analysis, the signal processing unit 80 extracts color components corresponding to the ratio of the color components constituting white defined by the white point (refer to FIG. 16), the color components serving as the luminance (gradation value) of the sub-pixel 48W for W. Specifically, the signal processing unit 80 determines the color components constituting white defined by the white point (e.g., (R,G,B)=(255,204,204) illustrated in FIG. 16) to be the highest luminance of white (W=255). The signal processing unit 80 extracts the components of white extractable from the required luminance value based on the ratio of the color components constituting white defined by the white point. In the case of (R,G,B)=(255,204,204) illustrated in FIG. 16, for example, the ratio of the color components constituting white is R:G:B=1:0.8:0.8. As illustrated in FIG. 24, let us assume a case where the components of the respective colors in the required luminance value is (R,G,B)=(360,360,128). In this case, the components of the respective colors extractable as the components of white based on R:G:B=1:0.8:0.8 is (R,G,B)=(160,160,128), which corresponds to W=160. The signal processing unit 80 substitutes W=160 for (R,G,B)=(160,160,128) and sets the gradation value of the sub-pixel 48W for W to 160. The signal processing unit 80 then subtracts, from the gradation values of R, G, and B, the gradation values extracted as the components constituting white. This operation converts the gradation values of the unit pixel 45A having color components of a required luminance value of (R,G,B)=(360,360,128), which corresponds to an RGB signal, into (R,G,B,W)=(200,232,0,160), which corresponds to an RGBW signal. In a case where the highest luminance of the color components that can be displayed by the external light $L_2$ is (R,G,B)=(255,208,208), the color component that requires the addition of the internal light $L_1$ is green (G) alone (Gf=24). Thus, the signal processing unit 80 according to the modification converts the required luminance value calculated in the analysis based on the RGB signal of the input signal into the RGBW signal.

The signal processing unit 80 subtracts the highest luminance of the color components that can be displayed by the external light $L_2$ from the required luminance value resulting from the conversion into the RGBW signal. The signal processing unit 80 determines the luminance corresponding to the luminance of remaining color components (to-be-added luminance) to be the color components of the luminance to be compensated with the internal light $L_1$. The subsequent processing in the analysis according to the modification is the same as that according to the embodiment above. More specifically, the signal processing unit 80 calculates the intensity of the internal light $L_1$ to compensate for the luminance deficiency of each color component using Equations (3) to (5). The signal processing unit 80 performs processing for turning on the light-emitting unit 51 based on the highest intensity of the calculated intensities of the internal light $L_1$ required for the respective color components. The highest intensity (FLMAX) of the internal light $L_1$, for example, is calculated using Equation (6).

In the processing at Step S8, the signal processing unit 80 calculates the gradation values of R, G, and B for the unit pixel 45A using Equations (7) to (9). The signal processing unit 80 then extracts, from the color components of the unit pixel 45A indicated by the calculated gradation values of R, G, and B, color components corresponding to the ratio of the color components constituting white defined by the white point, the extracted color components serving as the gradation value of the sub-pixel 48W for W in the unit pixel 45A. Subsequently, the signal processing unit 80 subtracts the values corresponding to the component amounts extracted as the gradation value of the sub-pixel 48W for W from the gradation values of R, G, and B. Thus, the signal processing unit 80 performs extension for converting the output signal into the RGBW signal. The processing for converting the color components of R, G, and B into white is the same as the processing for conversion into the RGBW signal in the analysis described with reference to FIG. 24. As described above, the signal processing unit 80 according to the modification performs the processing for converting the RGB signal into the RGBW signal. The specific configuration of the modification is the same as that of the embodiment above except for the specified characteristics.

As described above, the pixels 48 according to the modification each serve as a sub-pixel that outputs any one of the colors of R, G, B, and W. The display panel 30 according to the modification combines output from the sub-pixel 48R for R, the sub-pixel 48G for G, the sub-pixel 48B for B, and the sub-pixel 48W for W, thereby performing color reproduction. The gradation values corresponding to components convertible into white in the color components of R, G, and B indicated by the RGB signal are defined as the gradation value of the sub-pixel 48W for W. Thus, the color components convertible into white can be converted into white to be output. This mechanism can facilitate increasing the luminance with the sub-pixel 48W for W and reduce the addition of the internal light $L_1$ by the luminance increased by the sub-pixel 48W for W. Thus, the modification can further reduce the power consumption. Therefore, the modification can achieve both minimizing the addition of the internal light $L_1$ and securing desired luminance.

Application Example

Figure 25:
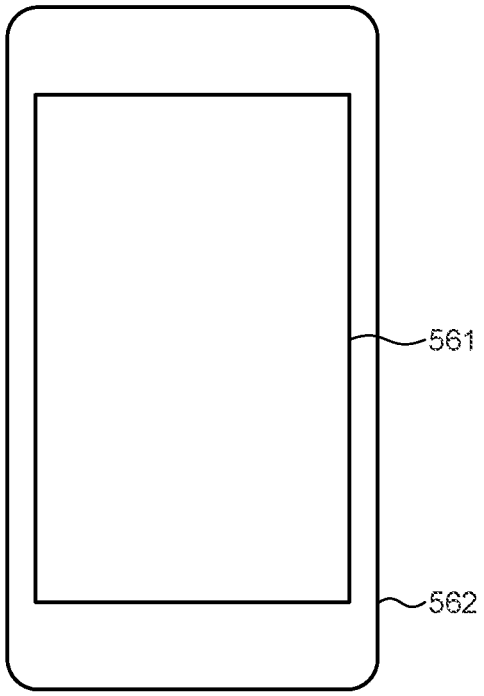
FIG. 25 is a schematic view of an example of an electronic apparatus to which the display device according to the embodiment and the like is applied.

The following describes an application example of the display device according to the embodiment and the modification (hereinafter, referred to as the embodiment and the like) with reference to FIG. 25. FIG. 25 is a schematic view of an example of an electronic apparatus to which the display device according to the embodiment and the like is applied. The display device according to the embodiment and the like is applicable to electronic apparatuses of all fields, such as car navigation systems, television apparatuses, digital cameras, notebook personal computers, portable electronic apparatuses like a mobile phone illustrated in FIG. 25, and video cameras. In other words, the display device according to the embodiment and the like is applicable to electronic apparatuses of all fields that display an image or video based on video signals received from the outside or video signals generated inside thereof.

An electronic apparatus illustrated in FIG. 25 is a portable information terminal to which the display device according to the embodiment and the like is applied. The portable information terminal operates as a mobile computer, a multifunctional mobile phone, a mobile computer capable of making a voice call, or a mobile computer capable of performing communications and may be called a smartphone or a tablet terminal. The portable information terminal includes a display unit 561 serving as the display device according to the embodiment and the like on the surface of a housing 562, for example. The display unit 561 has a function of the display device according to the embodiment and the like and a function of touch detection (what is called a touch panel) that can detect an external proximity object.

While the embodiment and the like according to the present invention have been described, the contents according to the embodiment and the like are not intended to limit the embodiment and the like. The components described above include components easily conceivable by those skilled in the art, components substantially identical therewith, and what is called equivalents. The components described above may be appropriately combined. Various omissions, substitutions, and changes of the components may be made without departing from the spirit of the embodiment and the like.

In a case where the display unit 10 performs monochromatic display, for example, the sensor Sen does not necessarily have the function to disperse light. In a case where the display unit 10 performs monochromatic display, the processing for calculating the required luminance value, the intensity of the internal light $L_1$, and the gradation values indicated by the output signal needs to be performed for a single color (monochrome). By using Equations above of any one of the colors without any change, the calculation is applicable to monochromatic display.

While a plurality of units of processing are provided in the embodiment and the like, the display unit 10 may use the entire valid display region as one unit of processing. In other words, the predetermined image display region in the display unit 10 may correspond to the entire valid display region in the display unit 10. In this case, the lighting unit 20 does not necessarily have the function to control the light-emitting regions individually. The predetermined image display region is not limited to those described above and may be arbitrarily provided in the valid display region in the display unit 10.

What is claimed is:

1. A display device that is a reflective display device comprising:

a display unit including a plurality of pixels included in the display unit and a reflective electrode having a reflective surface that reflects at least one of external light and internal light:

a front light source that emits light, as the internal light, toward the reflecting surface of the reflective electrode;

a sensor measuring an intensity of the external light that is emitted farther away from the front light source toward the display unit and a signal processor controlling an intensity of the internal light and a gradation value of each of the pixels based on the intensity of the external light measured by the sensor, wherein the signal processor calculates a required luminance value for a luminance value of a pixel to be N times (N>0) as high as a luminance value indicated by an input signal, the pixel performing output with the largest gradation value out of the pixels included in a predetermined image display region in the display unit, the control unit determines the intensity of the internal light based on a result of comparison between the intensity of the external light and the required luminance value, and the signal processor calculates an output gradation value of each of the pixels based on Equation (1):

$$0=I\times N/(OL+\mathrm{IL})$$

where OL denotes the intensity of the external light, IL denotes the intensity of the internal light, I denotes the gradation value indicated by the input signal, and O denotes the output gradation value of the pixel;

wherein the display unit includes a plurality of partial regions each having a plurality of pixels, the front light source includes a plurality of light-emitting regions that individually emit light to the respective partial regions, the light-emitting regions are capable of individually controlling the intensity of the internal light, and the signal processor defines one partial region as the predetermined image display region to calculate the required luminance value of one light-emitting region corresponding to the one partial region, determines the intensity of the internal light to be emitted from the one light-emitting region, and calculates the output gradation value of each of the pixels includes in the one partial region.

2. The display device according to claim 1, wherein the pixels serve as sub-pixels that each output any one of a plurality of colors, and the display unit combines output from the sub-pixels to perform color reproduction.

3. The display device according to claim 2, wherein the signal processor corrects the gradation value indicated by the input signal using a ratio of the colors constituting white that is reproduced by a combination of the colors and then calculates the output gradation value of each of the pixels based on Equation (1).

4. The display device according to claim 3, wherein the sensor measures intensities of color components of the respective colors included in the external light, and the signal processor defines a ratio of the intensities of the color components of the respective colors measured by the sensor as the ratio of the colors constituting white.

5. The display device according to claim 3, wherein the signal processor makes the ratio of the colors constituting white uniform.

6. The display device according to claim 2, wherein the pixels each serve as a sub-pixel that outputs any one of colors of red, green, and blue, and the display unit combines output from the sub-pixel for red, the sub-pixel for green, and the sub-pixel for blue to perform color reproduction based on the input signal in an RGB color space.

7. The display device according to claim 2, wherein the pixels each serve as a sub-pixel that outputs any one of colors of red, green, blue, and white, and the display unit combines output from the sub-pixel for red, the sub-pixel for green, the sub-pixel for blue, and the sub-pixel for white to perform color reproduction.

8. The display device according to claim 7, wherein the signal processor defines the gradation value corresponding to components convertible into white in the color components of red, green, and blue indicated by the input signal in an RGB color space as the gradation value indicated by the input signal for the sub-pixel for W.

9. The display device according to claim 1, wherein the signal processor calculates, when IL>0 is satisfied, the required luminance value under a condition that the output gradation value of the pixel that performs output with the largest gradation value out of the pixels included in the predetermined image display region is defined as a gradation value that makes light transmittance maximum.

* * * * *